US011976553B2

(12) United States Patent
Proett et al.

(10) Patent No.: US 11,976,553 B2
(45) Date of Patent: May 7, 2024

(54) DRILL STEM TESTING

(71) Applicant: Halliburton Energy Services, Inc., Houston, TX (US)

(72) Inventors: Mark Anton Proett, Missouri City, TX (US); Christopher Michael Jones, Katy, TX (US); Michel Joseph LeBlanc, Houston, TX (US); Anthony Herman van Zuilekom, Houston, TX (US); Mehdi Alipour Kallehbasti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/177,049

(22) Filed: Mar. 1, 2023

(65) Prior Publication Data

US 2023/0203945 A1 Jun. 29, 2023

Related U.S. Application Data

(63) Continuation of application No. 16/780,603, filed on Feb. 3, 2020, now Pat. No. 11,603,757.

(Continued)

(51) Int. Cl.

*E21B 49/00* (2006.01)
*E21B 47/06* (2012.01)

(Continued)

(52) U.S. Cl.

CPC ..... *E21B 49/008* (2013.01); *E21B 47/06* (2013.01); *E21B 47/07* (2020.05); *E21B 47/10* (2013.01);

(Continued)

(58) Field of Classification Search

CPC ..... E21B 47/06; E21B 47/10; E21B 47/113; E21B 47/114; E21B 49/008;

(Continued)

(56) References Cited

U.S. PATENT DOCUMENTS 5,473,939 A 12/1995 Leder et al.
8,087,292 B2 1/2012 Voelker (Continued)

OTHER PUBLICATIONS

PCT Application No. PCT/US2020/016435, International Preliminary Report on Patentability, dated Jan. 20, 2022, 7 pages.

(Continued)

*Primary Examiner* — Kristyn A Hall
(74) *Attorney, Agent, or Firm* — DeLizio, Peacock, Lewin & Guerra, LLP

(57) ABSTRACT

A test tool attached to test string comprising a fluid conduit is deployed to a test position within a wellbore. The deployment includes hydraulically isolating a portion of the wellbore proximate the test tool to form an isolation zone containing the test position. A fluid inflow test is performed within the isolation zone and an initial formation property and a fluid property are determined based on the fluid inflow test. A fluid injection test is performed within the isolation zone including applying an injection fluid through the test string into the isolation zone, wherein the flow rate or pressure of the injection fluid application is determined based, at least in part, on the at least one of the formation property and fluid property.

18 Claims, 10 Drawing Sheets

Related U.S. Application Data

(60) Provisional application No. 62/871,038, filed on Jul. 5, 2019.

(51) Int. Cl.

| | |
|---|---|
| ***E21B 47/07*** | (2012.01) |
| ***E21B 47/10*** | (2012.01) |
| ***E21B 49/08*** | (2006.01) |
| ***E21B 49/10*** | (2006.01) |
| *E21B 33/124* | (2006.01) |
| *E21B 37/00* | (2006.01) |
| *E21B 47/12* | (2012.01) |

(52) U.S. Cl.
CPC ..... *E21B 49/081* (2013.01); *E21B 49/10* (2013.01); *E21B 33/124* (2013.01); *E21B 37/00* (2013.01); *E21B 47/12* (2013.01); *E21B 49/0875* (2020.05)

(58) Field of Classification Search
CPC ..... E21B 49/081; E21B 49/10; E21B 49/087; E21B 49/0875
See application file for complete search history.

(56) References Cited

U.S. PATENT DOCUMENTS

| | | | | |
|---|---|---|---|---|
| 8,116,980 | B2 | 2/2012 | Beretta et al. | |
| 8,620,636 | B2 | 12/2013 | Zhan et al. | |
| 9,194,217 | B2 | 11/2015 | Watson et al. | |
| 9,581,017 | B2 | 2/2017 | Pipchuk et al. | |
| 9,945,224 | B2 | 4/2018 | Proett et al. | |
| 2003/0098156 | A1* | 5/2003 | Follini | E21B 17/1014 166/264 |
| 2004/0014606 | A1* | 1/2004 | Parlar | C09K 8/52 507/100 |
| 2006/0248949 | A1* | 11/2006 | Gregory | E21B 49/088 73/152.51 |
| 2008/0133194 | A1 | 6/2008 | Klumpen et al. | |
| 2009/0114010 | A1 | 5/2009 | Beretta et al. | |
| 2009/0272528 | A1 | 11/2009 | Voelker | |
| 2010/0242586 | A1 | 9/2010 | Elshahawi et al. | |
| 2012/0150515 | A1 | 6/2012 | Hariharan et al. | |
| 2013/0233619 | A1 | 9/2013 | Ramamoorthy et al. | |
| 2015/0034305 | A1 | 2/2015 | Tips | |
| 2015/0152715 | A1* | 6/2015 | Cunningham | E21B 47/06 166/205 |
| 2015/0218010 | A1* | 8/2015 | Benavides | C02F 1/008 210/741 |
| 2017/0030157 | A1 | 2/2017 | Hansen et al. | |
| 2021/0003003 | A1 | 1/2021 | Proett et al. | |

OTHER PUBLICATIONS

PCT Application Serial No. PCT/US2020/016435, International Search Report, dated Jun. 3, 2020, 3 pages.
PCT Application Serial No. PCT/US2020/016435, International Written Opinion, dated Jun. 3, 2020, 5 pages.
U.S. Appl. No. 16/780,603, Non-Final Office Action, dated May 27, 2021, 10 pages.
"U.S. Appl. No. 16/780,603 Final Office Action", dated Feb. 3, 2022, 10 pages.
Azzarone, et al., "Gas Injection Testing & PLT—Offshore Eni Experience", 10th Offshore Mediterranean Conference and Exhibition, Ravenna, Italy, Mar. 23-25, 2011, 12 pages.
Beretta, et al., "Value of Injection Testing as an Alternative to Conventional Well Testing: Field Experience in a Sour-Oil Reservoir", SPE Reservoir Evaluation & Engineering; Apr. 2007, 10 pages.
Tiani, et al., "Value of Unconventional Well Testing in Zero Emission Environment", Offshore Mediterranean Conference and Exhibition, Ravenna, Italy, Mar. 28-30, 2007, 9 pages.
Tripaldi, et al., "Injection Testing: an Innovative Field Application in Berkine Basin, Algeria", Offshore Mediterranean Conference and Exhibition, Ravenna, Italy, Mar. 25-27, 2009, 8 pages.
Verga, et al., "A New Numerical Model To Interpret Injection Tests", Offshore Mediterranean Conference and Exhibition, Ravenna, Italy, Mar. 28-30, 2007, 14 pages.

* cited by examiner

DRILL STEM TESTING

RELATED APPLICATIONS

This application is a continuation application of U.S. patent application Ser. No. 16/780,603, filed Feb. 3, 2020, which claims the benefit of priority to U.S. Provisional Patent Application Ser. No. 62/871,038, filed Jul. 5, 2019, both of which are incorporated by reference herein in their entireties.

BACKGROUND

The disclosure generally relates to the field of formation testing and more particularly to drill stem testing.

A variety of formation testing systems, components, and techniques are utilized for measuring, detecting, or otherwise determining formation properties. Drill stem testing is a category of formation testing typically utilized to determine formation rock permeability, production capacity, and other properties of a detected underground formation during and/or following drilling a borehole into the formation. A drill stem test (DST) apparatus includes components for measuring or otherwise determining formation permeability, structures, and in situ fluid compositional properties. This is accomplished by measuring fluid dynamics such as downhole pressures, pressure transients, and physical and chemical fluid properties.

A DST fundamentally entails pressure isolating one or more subsections, or zones, of an open or cased borehole (either may be referred to herein as a wellbore) and performing pressure and fluid composition testing within and sometimes proximate to the isolated zone(s). A DST procedure includes deploying DST tools configured within a bottom hole assembly (BHA) attached to or near the distal end of a fluid conduit such as drill piping sections of drill string within a wellbore. A DST BHA includes one or more packers that when deployed form a substantially sealed isolated test zone and isolated buffer zones that surround the isolated test zone. Within a pressure isolated zone (test or buffer), the DST tools include surface and/or downhole valves configured to open and close in accordance with a testing procedure to stimulate or prevent fluid flow by, for example, evacuating wellbore fluid including drilling mud and formation fluids into the BHA. The DST BHA components further include pressure sensors and data recorders configured to detect and record pressures, pressure transients, and flow rates as well as fluid properties.

The dynamic pressure behavior and fluid properties information collected by DSTs are utilized to determine optimal extraction means as well as the overall hydrocarbon extraction potential for a formation. While providing valuable formation properties information, DSTs are expensive in terms of the equipment, materials, and time required to perform the test and to handle and contain the evacuated hydrocarbon and drilling fluids. DST operations may also incur environmental safety risks due to the substantial volumes of hydrocarbons brought to the surface, requiring special storage or disposal.

BRIEF DESCRIPTION OF THE DRAWINGS

Embodiments of the disclosure may be better understood by referencing the accompanying drawings.

DESCRIPTION

Figure 1:
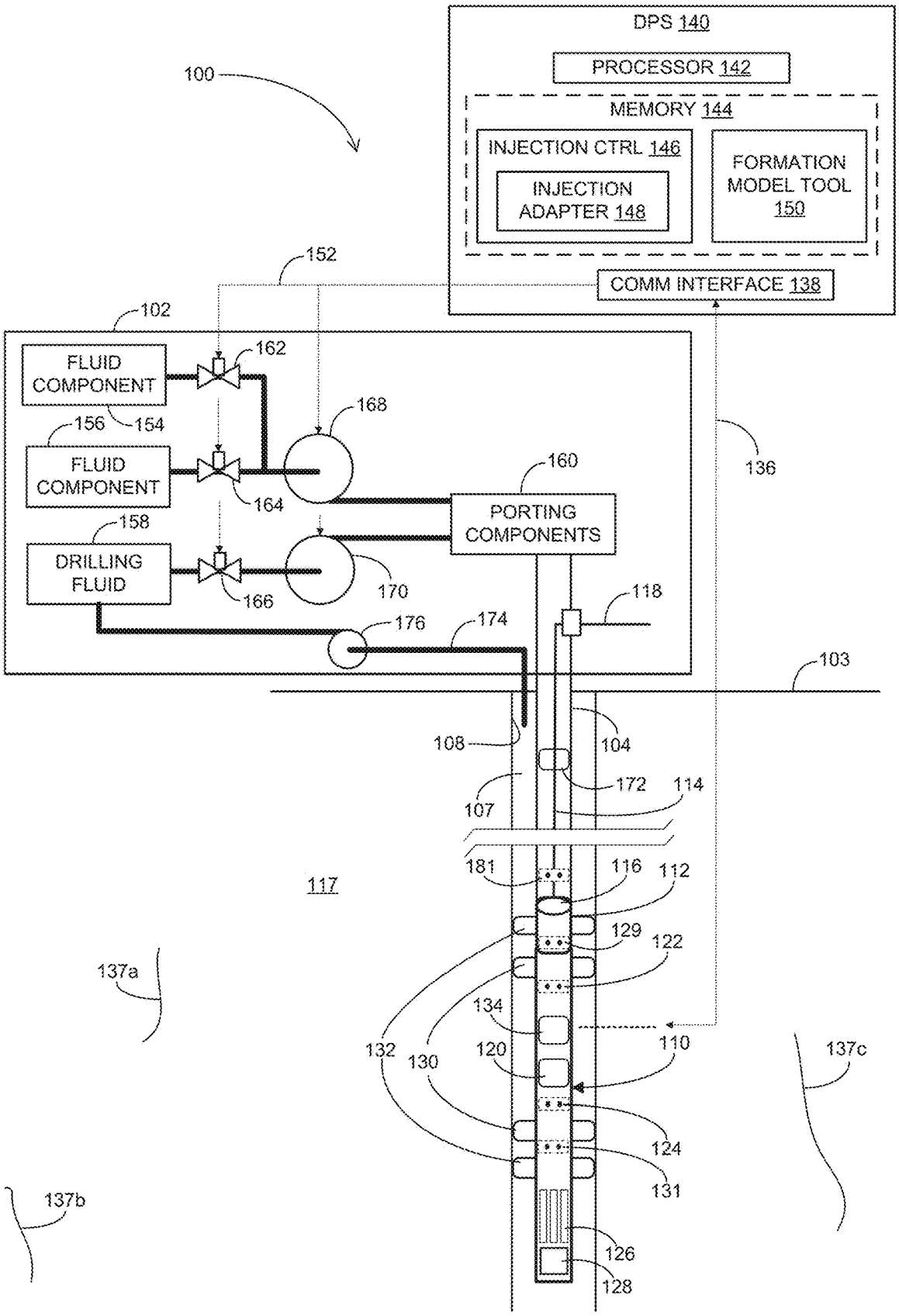
FIG. 1 is a block diagram depicting a formation test system in accordance with some embodiments.

The description that follows includes example systems, methods, techniques, and program flows that embody embodiments of the disclosure. However, it is understood that this disclosure may be practiced without some of these specific details. In other instances, well-known instruction instances, protocols, structures and techniques have not been shown in detail in order not to obfuscate the description.

Overview

Disclosed embodiments include systems, devices, components, and techniques for performing formation tests such as drill stem tests (DSTs) that comprehensively detect formation extent and pressure characteristics without requiring the substantial operating overhead required for standard intake type DSTs. In some embodiments, a DST string may be implemented as a BHA attached to drilling piping or other downhole conduit and positioned at a test location within a wellbore. As utilized herein, a BHA generally refers to a string of one or more components attached to or near the lower end of a string of drill piping or other conduits through which fluids may be transported. When deployed as or part of a BHA or similar drill sting configuration, the DST string may be operated intermittently between drilling cycles during which logging while drilling (LWD) and measuring while drilling (MWD) operations are performed. While embodiments may be performed using a drill string having a drilling BHA, the DST string may alternatively be deployed and operated as the BHA in which drilling pipe or coiled tubing are used to provide flow conduits between the surface and the test tool within the DST string BHA. A wireline assembly may be provided within the tubing conduit to provide power, communication and other signal exchange between surface equipment and the DST tool. In some embodiments, the DST string may be implemented as a wireline assembly that may not include drilling pipe or coiled tubing as fluid conduits. The DST string may include components configured to remove filter cake (also referred to as drilling mud cake) from the formation wall to increase the ability of the wellbore to produce fluids from the formation by drawdown into the tool or to receive via injection from the tool fluids into the formation.

A DST string may include a test tool configured to measure formation properties including properties of formation fluids. The DST string further includes flow control components such as pumps and values to perform both fluid withdrawal and fluid injection operations within a wellbore. In some embodiments, a formation test cycle begins with positioning the DST string proximate to a formation test position at a point along the wellbore. The DST string may be deployed as a BHA and positioned by extending and/or withdrawing a drill pipe conduit to which a DST BHA is attached. Alternatively, the DST string may be lowered into position directly along a wireline. With the DST string positioned, a pump or other component is activated to deploy, via inflation or otherwise, wellbore isolation packers to create a hydraulically isolated zone (isolation zone) over at least a portion of the length of the DST BHA. Hydraulic probes which make contact with the formation such as represented by probes 208 and 248 in FIGS. 2A, 2C, 2D, and 2E may also be extended by other means. The probes such as those shown in FIGS. 2A, 2C, 2D, and 2E may form one or more hydraulic contacts with the formation at one or more depths. Such probes generally form a discontinuous radial isolation region with the wellbore.

A DST string may include fluid inlet and outlet ports through which fluids may be withdrawn from and injected into the annular wellbore region within the isolation zone. A formation test tool within the DST string may be equipped with pumps to facilitate injection or withdrawal of fluids from the isolation zone. In some embodiments, a formation test interval begins with a fluid intake DST in which fluid is withdrawn into the test tool and various fluid and flow properties measured. Valves and/or other flow control devices within the test tool and/or other portions of the DST string are actuated to induce inflow into the test tool. The inflow period may vary and in some embodiments is performed at a specified flow rate and/or over a period adequate to remove filter cake and other flow obstructions and contaminants from an inner wellbore surface within the isolation zone. During and following formation fluid intake, measurement components are utilized to determine fluid composition and flow rate metrics and properties such as viscosity, material composition, temperature, flow rate, pressure, and pressure transients. The formation test interval further includes a fluid injection DST that follows the fluid intake DST. The fluid intake DST supports the fluid injection DST in terms of preparing the wellbore wall for optimal injection results and also by providing information utilized to determine operating parameters for the fluid injection DST. A formation test interval may conclude with determination of relatively extensive formation permeability information based on the results of the fluid injection DST.

Example Illustrations

FIG. 1 is a block diagram depicting a formation test system 100 configured and implemented within a well system in accordance with some embodiments.

Formation test system 100 includes subsystems, devices, and components configured to implement a two-stage fluid flow and testing procedure within a wellbore 107 that in the depicted embodiments is an uncased, open borehole. Formation test system 100 includes wellhead system 102 that includes components for configuring and controlling deployment in terms of insertion and withdrawal of a test string 104 within wellbore 107. Test string 104 may comprise multiple connected drill pipes, coiled tubing, or other downhole fluid conduit that is extended and retracted using compatible drill string conveyance components (not depicted) within wellhead system 102. In some embodiments the wellbore or annular section of the wellbore may in part form the conduit as a fluid path from the surface to the BHA. In some embodiments, the conduit may be formed in part by a combination of conduits.

Test string 104 is utilized as the conveyance means for a test tool 110 that is attached via a connector section 112 to the distal end of test string 104. For example, test tool 110 may be attached such as by a threaded coupling to connector section 112, which may similarly be attached by threaded coupling to the end of test string 104. Alternatively, the test string may be lowered into position by wireline, slickline, coiled tubing, or moved into position by tractor. In addition to providing the means for extending and withdrawing test tool 110 within wellbore 107, test string 104 and connector section 112 form or include internal fluid conduits through which fluids may be withdrawn from or provided to test tool 110. Test string 104 includes fluid connectors and electrical connectors. The function of the fluid connectors and electrical connectors may be divided into more than one part, one for the electrical connection and one for the fluid connection. In the embodiment for which the conveyance system is the wireline and the upper portion of the fluid conduit is the wellbore 107, the fluid connector may be disposed on the exterior of test string 104 open to the wellbore to draw fluid from the wellbore. In this embodiment the wellbore may be isolated at surface from atmospheric pressure, and the wellbore pressurized to drive fluid to test tool 110. If the fluid provided is drilling mud, the connector may contain a filter to remove particles prior to injection from test tool 110.

Communication and power source coupling are provided to test tool 110 via a wireline cable 114 having one or more communication and power terminals within wellhead system 102. In some embodiments, wireline 114 is connected to test tool 110 following positioning of test tool 110 within wellbore 107. For instance, connector section 112 may include a seating for a wet latch 116 that is inserted into test string 104 such as via a side entry portal 118. Wet latch 116 may comprise an elastomeric dart that is attached to an end connector (not depicted) of wireline 114. To connect wireline 114 with test tool 110, wet latch 116 is pumped downward through test string 104 using a fluid medium such as drilling mud until wet latch 116 seats within connector section 112 resulting in the end connector of wireline 114 electrically connecting to test tool 110.

Test tool 110 comprises components, including components not expressly depicted in FIG. 1, configured to implement fluid intake testing that facilitates the fluid injection testing. Test tool 110 includes flow control devices 120 for implementing and regulating inflow of formation and other fluids into test tool 110 and outflow of drilling fluids, injection test fluids, and borehole cleaning fluids from test tool 110. For example, flow control devices 120 may comprise a combination of one or more valves and/or pumps mutually configured to provide flow pathways and flow inducement pressures for withdrawing formation fluids into test tool 110 from the annular region of wellbore 107 surrounding test tool 110. Flow control devices 120 intake fluid from and inject fluid into the annular wellbore region via a set of one or more flow ports 122 within connector section 112 and flow ports 124 within test tool 110 itself.

In some embodiments flow ports 122 and 124 may be configured as orifices disposed at the body surface of connector section 112 and test tool 110, respectively. In addition or alternatively, flow ports 122 and 124 may be configured as outwardly extending flow probes having a flow port positioned on or driven within an inner borehole surface 108 of wellbore 107. Ports 122 and 124 may be incorporated between and/or integrated within isolation packers 130 and 132 as open orifices exposed within wellbore 107 or as extended probes employed by wireline and LWD formation testers.

Figure 2A:
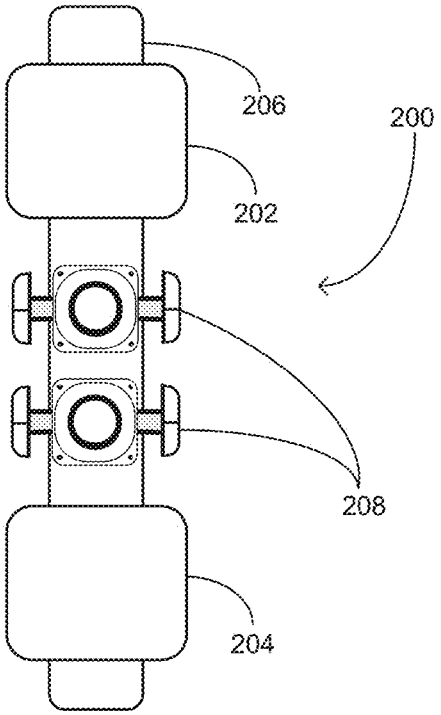
FIGS. 2A-2E depict packer assemblies, aspects of which may be incorporated into a DST string in accordance with some embodiments.
Figure 2B:
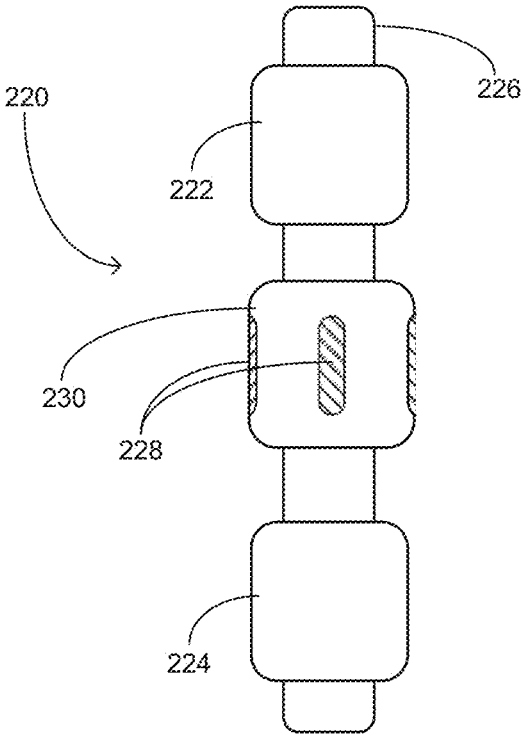
Figure 2C:
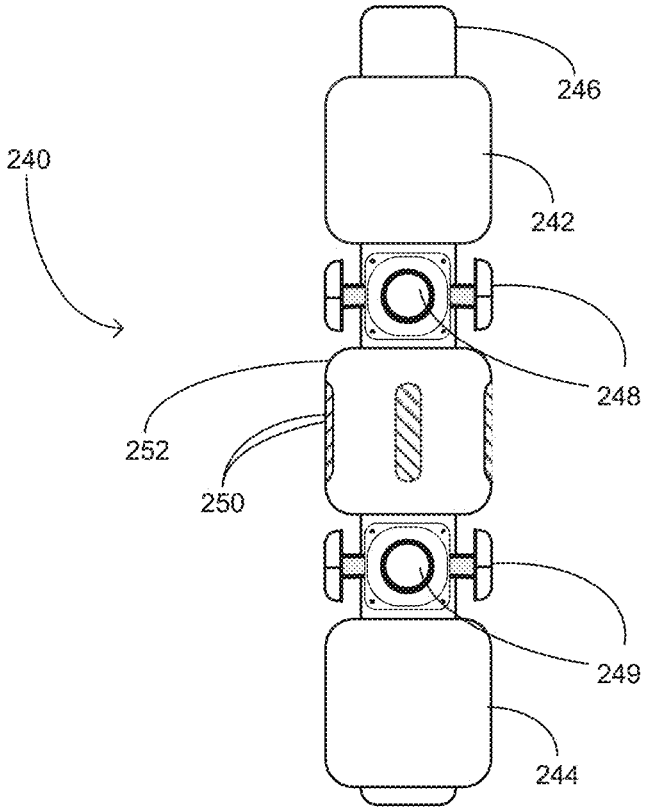

For example, FIGS. 2A-2C depict packer and probe assemblies, aspects of which may be incorporated into test tool 110. FIG. 2A illustrates a packer and probe assembly 200 comprising a pair of inflatable packers 202 and 204 deployed on a test tool body 206. In this embodiment, multiple probes including probes 208 extend radially outwardly from test tool body 206 in the isolation zone between inflatable packers 202 and 204. FIG. 2B depicts a packer and probe assembly 220 comprising a pair of inflatable packers 222 and 224 deployed on a test tool body 226. In this embodiment, multiple probes including probe 228 are deployed at the surface of a packer 230 that is disposed in the isolated zone between packers 222 and 224. FIG. 2C illustrates a packer and probe assembly 240 comprising a pair of inflatable packers 242 and 244 deployed on a test tool body 246. In this embodiment, a first set of multiple non-packer probes including non-packer probes 248 are deployed between packers 242 and 252, and a second set of non-packer probes 249 are deployed between packers 252 and 244. A set of packer probes including packer probes 250 are deployed on a packer 252 that is disposed between non-packer probes 248.

Figure 2D:
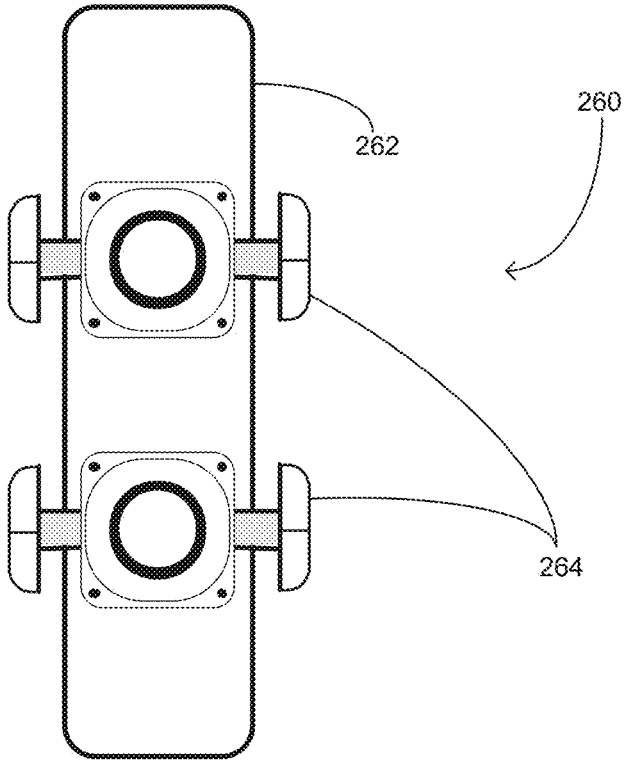
Figure 2E:
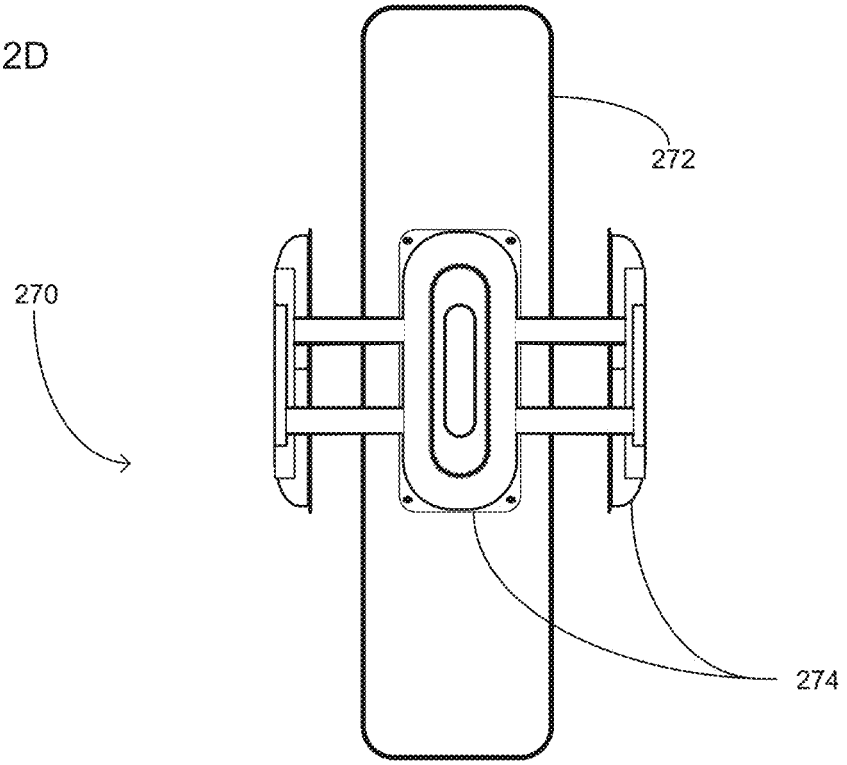

The probes 208 in FIG. 2A and 248 and 249 in FIG. 2C may be self-sealing in terms of including a seal pad surrounding the intake orifice. In such embodiments, the test tool may not require packers to provide isolation zones during testing and the isolation zone is the enclosed volume sealed by the seal pad. For example, FIGS. 2D and 2E depict probe assemblies that may be deployed without packers. FIG. 2D depicts a probe assembly 260 comprising multiple outwardly extensible probes including probes 264 deployed on a test tool body 262. Probes 264 are self-sealing circular probes that may be extended outwardly from test tool body 262 to contact a portion of a wellbore wall surface and form an isolation zone thereon. FIG. 2E depicts a probe assembly 270 comprising multiple outwardly extensible probes including probes 274 deployed on a test tool body 272. Probes 274 are self-sealing focused oval probes that may be extended outwardly from test tool body 262 to contact a portion of a wellbore wall surface and form an isolation zone thereon.

Returning to FIG. 1, test tool 110 further comprises measurement instruments 128 for measuring, detecting, or otherwise determining properties of the intake fluid flow and fluid property metrics for wellbore fluids and for detecting fluid pressure within wellbore 107 during injection testing. For example, measurement instruments 128 may include one or more pressure detectors for determining formation fluid pressures within isolated or non-isolated portions of wellbore 107. The pressure detector(s) within measurement instruments 128 may include a pressure recorder for recording a pressure transient comprising pressure values measured over a time period such as a pressure rise or build up period following an intake flow and/or a pressure drop or fall off period following an injection flow. Measurement instruments 128 may further include a flow rate detector for measuring and recording flow rates of fluids withdrawn by and/or injected from test tool 110 into a formation 117. Measurement instruments 128 further include fluid properties detectors for measuring composition, fluid viscosity and compressibility and/or environment properties such as temperature and pressure. Test tool 110 may further include a sample chamber 126 for collecting fluid samples to be locally tested by measurement instruments 128 and/or to be stored for later measurement analysis by a surface fluid testing system. Fluid property sensors within measurement instruments 128 may be used to determine the quality of the samples including but not limited to the characteristics of filtrate contamination level, representativeness of the formation fluid from which it was withdrawn, and asphaltene state, or asphaltene onset pressure.

Test tool 110 is configured to communicate the measured fluid property values as well as intake and injection test operation information to a surface data processing system (DPS) 140. Test tool 110 may directly communicate measurement and other information via wireline 114 and/or via an alternate communication interface 134 such as but not limited to computer memory devices and systems. Test tool 110 may communicate to DPS 140 via a telemetry link 136 using communication interface 134 if, for example, wireline 114 is not included in the system or does not include a sufficient communication channel. Telemetry link 136 includes transmission media and endpoint interface components configured to employ a variety of communication modes. The communication modes may comprise different signal and modulation types carried using one or more different transmission media such as acoustic, electromagnetic, and optical fiber media. For example, pressure pulses can be sent from the surface using the fluid in the drill pipe as the physical communication channel and those pulses received and interpreted by test tool 110.

While depicted as a single box for ease of illustration, DPS 140 may be implemented in any of one or more of a variety of standalone or networked computer processing environments. As shown, DPS 140 may operate above a terrain surface 103 within or proximate to wellhead system 102, for example. DPS 140 includes processing and storage components configured to receive and process injection test procedure and downhole measurement information to generate flow control signals. DPS 140 may be further configured to process injection test data received from test tool 110, such as pressure transient data, to determine permeability, physical extent, and hydrocarbon capacity of formation 117. DPS 140 comprises, in part, a computer processor 142 and a memory device 144 configured to execute program instructions for generating the flow control signals and the formation properties information. A communication interface 138 is configured to transmit and receive signals to and from test tool 110 as well as other devices within formation test system 100 using a communication channel with wireline 114 as well as telemetry links 136 and 152.

DPS 140 is configured to control various flow control components such as surface and downhole pumps and valves to enable coordinated transport, including initial injection fluid mixing and fluid separation during transport to formation test sites within wellbore 107. Executing as loaded within memory 144, an injection controller application 146 is configured to implement intake fluid flow testing in coordination with injection flow testing. Injection controller 146 is configured using any combination of program instructions and data to process flow control system configuration information in conjunction with injection procedure parameters to generate the flow control signals. The flow control system configuration information may include pump flow capacities and overall fluid throughput capacities of the surface and sub-surface flow control networks. Injection controller 146 includes an injection adapter application 148 that is configured to modify flow control signals and/or generate injection fluid component mixing instructions/signals based, at least in part, on fluid and formation properties measurement information generated and collected by test tool 110 such as during fluid intake testing.

Injection controller 146 is configured, using a combination of program instructions and calls to control activation of flow control devices including a pair of pumps 168 and 170. Each of pumps 168 and 170 is a fluid transfer pump such as a positive-displacement pump. Each of pumps 168 and 170 is configured to drive fluid from a respective fluid source into and through test string 104 via porting components 160. In the depicted embodiment, pump 168 is configured to pump injection fluid for injection testing, and pump 170 is configured to pump drilling fluid, sometimes referred to as drilling mud, in support of drilling and formation testing operations. For some embodiments, in which base oil is the injection fluid, it may be supplied directly from the drilling mud system by the drilling mud pump 170. Base fluid, such as base oil, may be generated from the drilling mud by downhole filtration. In other embodiments, the drilling mud pump 170 may be used to supply fluids other than a drilling fluid for injection operations. In this manner, pump 170 may be substituted for pump 168 to supply injection fluid during fluid injection operations. In such embodiments, pump 170 may connect directly to injection fluid sources 154 or 156 in addition to connecting to drilling fluid source 158. The wellhead system includes a recirculation line 174 driven by a recirculation pump 176 that recirculates the drilling fluid from wellbore 107 into drilling fluid source 158 such as when operating in drill mode and during downhole testing and sampling.

For embodiments in which the injection fluid is provided independently of the drilling mud system, pump 168 is configured to receive fluid from one or more injection fluid sources such as a first injection fluid source 154 and a second injection fluid source 156. Injection fluid source 154 contains or otherwise supplies an injection fluid having a different composition than the composition of fluid from fluid injection source 156. For example, the fluid supplied by injection fluid source 154 may comprise a primary injection fluid in the form of diesel, drilling fluid filtrate (oil or water or emulsion), and/or treated water such as treated sea water. Injection fluid source 156 may supply a secondary, additive-type fluid having a relatively high or low viscosity and be mixed with the primary injection fluid to form a viscosity adjusted injection fluid mixture to be transported downhole. Furthermore, additives may be mixed with one or both of fluid sources 154 and 156 to adjust the wettability characteristics of the injection fluid. Pump 170 is configured to receive fluid from a drilling fluid source 158, which may supply for example oil-based drilling mud. Pumps 168 and 170 are configured to drive fluid from a respective one or more sources into the fluid conduit formed by test string 104 via the porting components 160. One or multiple pumps may be configured in parallel or series with pumps 168 and/or 170 to achieve injection characteristics such as but not limited to injection pressure, flowrate and flowrate control. A throttling system may be used downhole within test tool 110, in the formation tester connector section 112, and/or within DPS 140 to control flow rate.

In some embodiments, formation test system 100 may be configured to obtain and utilize formation fluid as an optimally compatible injection fluid for injection test operations. For example, formation fluid may be withdrawn into test tool 110 via flow ports 122 and/or 124 with flow control devices 120 configured for fluid intake. The formation fluid may be pumped or otherwise driven into a downhole containment volume that may comprise downhole fluid containers. Alternatively, the downhole containment volume may comprise the upper, non-isolated portion of wellbore 107 and/or the upper piping portion of test string 104. For example, the formation fluid may be pumped into the upper portion of wellbore 107 via ports 181 that are controllably opened and closed via valves (not depicted) within drill string 104.

Whether collected within downhole containers, the upper portion of test string 104, and/or the upper portion of wellbore 107, the formation fluid may be applied as the injection fluid during formation pressure transient tests. If collected above test tool 110, for instance, the hydrostatic pressure head provides a pressure differential above formation pressure enabling the formation fluid to be injected back into the formation at a higher rate than withdrawn. In some embodiments, additional pressure may be applied by surface pumps 168 and/or 170 via porting components 160 to the fluid column within test string 104. If the formation fluid is withdrawn from the same zone for which it is be injected, then a wait time may be introduced to allow the formation pressure to reestablish steady state pressure between the withdraw and injection.

Each of pumps 168 and 170 may include a control interface (not depicted) such as a locally installed activation and switching microcontroller that receives activation and switching instructions from DPS 140 via telemetry link 152. For instance, the activation instructions may comprise instructions to activate or deactivate the pump and/or to activate or deactivate pressurized operation by which the pump applies pressure to drive the fluid received from a response of the fluid sources into and through test string 104. Switching instructions may comprise instructions to switch to, from, and/or between different fluid pumping modes. For instance, a switching instruction may instruct the target pump 168 and/or 170 to switch from low flow rate (low pressure) operation to higher flow rate (higher pressure) operation.

By issuing coordinated activation and switching instructions to pumps 168 and 170, DPS 140 controls and coordinates flows and flow rates of fluids from each of fluid sources 154, 156, and 158 through test string 104. Additional flow control, including individual control of flow from the fluid sources 154, 156, and 158 to pumps 168 and 170 is provided by electronically actuated valves 162, 164, and 166. Each of valves 162, 164, and 166 includes a control interface (not depicted) such as a locally installed microcontroller that receives valve position instructions from DPS 140 via telemetry link 152. For instance, the valve position instructions may comprise instructions to open, close, or otherwise modify the flow control position of the valve. Individually, or in combination with pump operation instructions, DPS 140 may control pressure and rate of flow from each of fluid sources 154, 156, and 158.

The components of formation test system 100 are configured to implement inflow and injection flow testing from which properties such as but not limited to formation mobility, permeability, porosity, rock-fluid compressibility, skin factor, anisotropy, reservoir geometry, and reservoir extent are determined. As shown, hydrocarbon formation 117 includes physical discontinuities 137*a*, 137*b*, and 137*c*, each representing either a formation edge or an internal formation discontinuity such as but not limited to a fault or low permeability zone that manifests as a pressure and/or fluid flow barrier. Traditional DSTs entail fluid intake flow rate and pressure transient testing to locate formation edges and internal formation discontinuities. However, logistical, safety, and environmental issues limit the rate at which fluid may be withdrawn such as by reducing wellbore pressure to induce inflow. Therefore, fluid intake test typically requires large volumes of fluid be withdrawn at relatively low flow rates, resulting in substantial expense in terms of equipment overhead and otherwise to capture and contain the withdrawn formation fluid content.

In some embodiments, formation test system 100 addresses issues posed by traditional DST by implementing a dual phase formation test cycle in which a fluid inflow test phase precedes and facilitates a subsequent fluid injection phase. A formation test cycle may begin with drill string position components (not depicted) within wellhead 102 extending or retracting test string 104 to position test tool 110 at a formation test site within wellbore 107. With test tool 110 positioned, components such as a pump within flow control devices 120 deploys a pair of isolation packers 130 such as by inflating packers 130 to form hydraulic and pressure barriers to wellbore fluid above and below an isolated test zone formed between isolation packers 130. In some embodiments, the system may include an additional one or more packers such as buffer packers 132 that are deployed to form additional hydraulically isolated buffer zones to facilitate formation testing such as by providing a buffer to, for example, prevent or reduce pressure noise that may otherwise interfere with measurements within the isolated test zone. Buffer packers 132 may not make hydraulic contact with the formation (inside wall 108 of wellbore 107) and are pressurized above formation pressure above or below hydrostatic pressure. With buffer packers 132 deployed, pressure zones are formed in the wellbore space between packers 130 and 132. In the depicted embodiment, flow ports 129 and flow ports 131 which may comprise intake probes, are disposed between the upper and/or lower buffer packers 132 and the upper one of isolation packers 130 and may be used for fluid intake and/or fluid injection. Additionally, one or more probes may be used independent of buffer packers.

Following positioning of test tool 110, prior or subsequent to deployment of packers 130 and 132, wet latch 116 is pumped down to connector section 112 where it seats and effectuates connectivity of wireline 114 with test tool 110. Test string 104 may contain drilling fluid prior to pumping down of wet latch 116. In some embodiments, wellhead system 102 is configured to pump wet latch 116 down to connector section 112 using injection fluid such as from injection fluids source 154 and/or 156. Wet latch 116 may comprise a sealing plug such as a piston plug to separate the injection fluid (e.g., diesel) from the drilling fluid with test string 104. In some embodiments, wet latch 116 may comprise an elastomeric body member having brush contact edges or other soft elastomeric edges to form a substantially fluid impermeable seal against the inner conduit surface of test string 104. In this manner, wet latch 116 in addition to implementing wireline connection performs a conduit flushing function by flushing the drilling fluid out of test string 104 through an exit port provided by flow ports 122 or 124. In other embodiments, the conveyance system is the wireline, and therefore a wet latch is not used as the connector. In yet other embodiments, the drilling fluid mud is filtered at the BHA to provide drilling fluid base oil as an injection fluid. For this embodiment, the wellbore may form in part the conduit. The BHA in this embodiment would contain a filter section to produce a fluid that in part contains drilling fluid base oil.

Although the primary function of the DST BHA comprising test tool 110 and connector section 112 is to facilitate the injection of fluid into the formation, it may be configured to facilitate fluid inflow into the tool, such as for the purpose of cleaning the wellbore or for performing measurements on the formation fluids. Such capability may be provided by components such as pumps and valves. Reversible pumps may be used such that the same pump can be used for either outflow into the wellbore and inflow from the wellbore into the tool.

Following establishment of the isolated test and buffer zones and connection of wireline 114, test tool 110 and other components within formation test system 100 may implement a formation test preparation phase to optimize fluid intake testing particularly if wellbore 107 is an open borehole. Such test preparation phase may involve testing the injectability of the formation by pumping fluid into the wellbore, or testing the permeability of the formation by drawing in fluid from the wellbore. For example, wellhead system 102 such as may be controlled in part by DPS 140 in combination with a downhole pump within test tool 110 may drive injection fluid into the isolated test zone with mud cake intact on an inner surface 108 of wellbore 107 in order to measure the leak rate of the filter cake. For example, the leak rate may be determined by relatively small-scale injection and/or withdrawal of fluid from wellbore over a specified period and measuring the rate of fluid transfer to provide in situ information about the permeability of the wellbore mud cake layer.

The leak rate of the filter cake may be utilized to optimize subsequent drilling operations at or proximate wellbore 107 to optimize acquisition of formation fluid samples during the fluid intake test phase, or to help establish a cleaning program for removing the mud cake to facilitate injection. The fluid properties measured during the fluid intake phase may be used to extrapolate clean formation fluid properties as well as drilling fluid filtrate contamination levels such that fluid sampling and analysis begins at a point during fluid intake at which the fluid is relatively free of borehole contaminants. Further, the leak rate of the filter cake may be a significant parameter in interpreting the data from the fluid injection test in order to determine formation parameters such as but not limited to barriers to flow within the formation, reservoir extent, reservoir geometry, permeability, porosity and anisotropy.

The fluid inflow test phase may be performed with test string 104 containing injection fluid with wet latch 116 acting as a flushing plug that separates the drilling fluid initially contained in test string 104 from the injection fluid. The drilling fluid is swept out of test string 104 via flow ports 122, 129, and/or 124. If the fluid intake test is performed on a different test cycle, or with drilling fluid filling test string 104, another piston plug 172 is used to separate the drilling fluid from the injection fluid as the injection fluid sweeps test string 104. Each of piston plug 172 and subsequent piston plugs include a center hole through which wireline 114 passes as the plug is pumped downhole to plug receptacles within connector section 112 and/or test tool 110. A fluid such as a fluorocarbon that is neither soluble in water nor oil fluids, or the like, may also be used to separate the injection fluid from the filter cake and drilling fluid. In some embodiments, the selected fluid has a density between that of the injection fluid and the drilling fluid, and not be soluble in either the injection fluid or the drilling fluid.

To clean the isolated test zone and/or test tool 110 prior to the fluid intake test, a pump within flow control devices 120 may be actuated to flush test tool 110 with the injection fluid. The isolated test zone (i.e., annular space between packers 130 that makes hydraulic contact with the inner wall 108 of wellbore 107) may also be flushed with injection fluid to optimize subsequent intake and injection fluid testing. This may remove the filter cake from the region of wellbore 107 within the isolated test zone. This flushing of the tool and isolated test zone entails injecting injection fluid and evacuating fluid from the isolated test zone. The flushing may be accomplished by pumping the injection fluid into the isolated test zone and evacuating the resultant mixture at the top or bottom positions within the isolated test zone determined by fluid density. If the injection fluid is less dense than the drilling fluid, for example, a top down flushing of the drilling fluid and filter cake may be implemented by injecting nearer the top (e.g., from flow ports 122) and evacuating nearer the bottom (e.g., into flow ports 124). Alternatively, the isolated test zone may be cleaned with fluid from formation 117 in the process of a fluid intake test. In this embodiment, formation fluid is withdrawn from formation 117 thereby clearing the filter cake from the walls of the wellbore within the isolated test zone prior to the fluid injection test. Fluids drawn into test tool 110 may be expelled into the annulus section of the wellbore above the isolated test zone, in the annulus below the isolated test zone, in a storage container within test tool 110, or driven up through test string 104 for temporary storage.

In the absence of or following the preliminary isolated test zone flushing, the fluid intake phase of a formation test cycle begins with test tool 110 actuating one or more of flow control devices 120 such as a fluid intake valve. The valve actuation alone or in conjunction with negative pump pressure implements negative pressure within the isolated test zone between packers 130 that induces flow of formation fluid into test tool 110 such as via flow ports 122 or 124. During and following fluid intake test tool 110 performs fluid and formation properties testing. The fluid properties to be determined include composition, contamination level (with respect to drilling fluid filtrate), viscosity, compressibility, bubble point, and gas-to-oil ratio. The injection fluid may be tested using downhole sensors to determine fluid properties such as viscosity, density and or composition. The injection fluid may also be sampled downhole so that fluid properties may be later determined. The viscosity value determined in situ or from the sampled fluid may be used in combination with one or more pressure sensors to determine flow rate of the injection fluid at various stages throughout the injection testing.

Alternatively, a known pump rate may be used to calibrate two pressure gauges at different positions within the flow line of the BHA in order to directly measure flow rate. Such a measurement is improved by having a known injection fluid density, the height difference of the two different pressure sensors, and a zero flow reference to normalize the two pressure gauges. In some embodiments, test tool 110 determines fluid properties such as temperature and pressure by directly measuring using measurement instruments 128. Measured pressures may include sand face pressures within the isolated test zone and are used to determine a pressure rise transient determined over a period during and/or following the termination of the withdrawal of fluid from the isolated test zone. The pressure transient may be processed by components within test tool 110 and/or DPS 140 to determine near wellbore properties such as formation mobility or permeability. Pressures within the isolated buffer zones formed between packers 130 and 132 may also be measured to optimize computation of the isolated test zone pressures by, for example, cancelling low frequency pressure interference generated above and below the barrier zones. Methods for canceling such interference noise from outside the isolated test zone include but are not limited to autocorrelation techniques, or a physical mode fit of the location-based pressure measurements. These types of isolated test zone pressure measurement correction may also be implemented to correct pressure measurements performed for a corresponding fluid injection test.

Pressure measurements between the packers may account for effects such as deformation of the packers, in order to better determine formation properties. During the fluid inflow test a sample or samples may be acquired for subsequent laboratory analysis. Fluid intake tests may be performed within wellbore 107 at multiple locations, to find a suitable location for a fluid injection test, or to map the fluid variation within a reservoir to be used to better interpret formation properties from the injection test. Samples may be acquired form these multiple locations and/or at different stages of the fluid intake test at the different locations such as by flow ports 129 from the isolated buffer zone. Monitoring of the fluid properties may take place as a function of time or as a function volume of fluid flowed in. The fluid properties measured at different stages (for instance time based or volume based) of the fluid intake test may be interpreted to provide fluid properties of the clean representative formation fluid properties. Such an interpretation may be performed by extrapolating the fluid properties according to a model which describes the inflow test as a function of time or volume or interpreted with equation of state techniques during a single inflow test or across multiple inflow tests.

Measurement instruments 128 may also perform fluid content analysis to determine properties such as viscosity, compressibility, and chemical composition. Measurement instruments 128 further include components configured to determine and record a pressure transient such as a pressure rise during and/or following the period over which formation fluid is withdrawn into test tool 110. The pressure transient information may be processed by processing components within measurement instruments 128 to calculate or otherwise determine a formation mobility, permeability, and/or anisotropy. Anisotropy measurements require a second probe distal to the isolated test zone and separate from the isolated buffer zone(s). Alternatively, the pressure transient information may be transmitted to DPS 140, which includes components such as formation model tool 150 that are configured to determine formation permeability based on the pressure transient information.

Prior to a fluid injection test phase, the fluid and formation properties data including but not limited to a combination of formation pressure and permeability and fluid composition, fluid viscosity, and fluid density are processed by DPS 140 to optimize the injection fluid composition and fluid injection parameters such as injection pressure and flow rate. Regarding injection fluid composition, injection controller 146 and injection adapter 148 are configured to select or generate by mixing, an injection fluid having a viscosity and/or a density and/or a wettability that matches formation fluid viscosity and/or density and/or wettability to within a threshold. Wettability for instance may be adjusted in order to match the expected wettability characteristics of the formation for instance if prior formation information is obtained, or adjusted based on the composition of the formation fluid, for instance from saturates, aromatics, resins, and asphaltene (SARA compositor) data.

In response to one or more of the received fluid and formation properties values including, for some embodiments, the values such as exceeding a threshold, injection controller 146 calls or otherwise executes injection adapter 148 to cause injector 148 to generate an adapted injection procedure. The injection procedure may specify an injection fluid composition which may comprise a combination of components from fluid sources 154 and 156 that most nearly matches the formation fluid viscosity. In addition to viscosity matching, injection adapter 148 may be configured to select or generate by mixing an injection fluid that matches other formation fluid properties such as density and salinity. For instance, if the injection fluid comprises salt water such as seawater, sulfate may be removed and/or other ions may be removed to prevent scale, swelling, or other formation damage. Scale inhibition components may also be added to the injection fluid. Oil based injection fluids such as but not limited to diesel or drilling fluid base oil, may contain compounds to prevent the precipitation of asphaltenes within the formation. One such compound is d-limonene, however, other compounds that exhibit scale inhibition may be utilized. Injection fluid containing in part base oil may be generated from drilling fluid by filtration. In other embodiments, injection fluid may be carried downhole in containers as part of the BHA.

In addition to regulating injection fluid composition, components within wellhead 102, DPS 140, and/or test tool 110 are configured to determine the flow rates and flow pressures applied during the fluid injection test phase. For instance, injection controller 146 and injection adapter 148 may be configured to determine and implement a fluid injection procedure that applies a flow rate and/or flow pressure that may be modified from a default flow rate/pressure based on formation permeability and other formation and fluid properties measured or otherwise generated by the fluid intake testing. Injection controller 146 may apply other parameters to limit or otherwise determine flow rates and pressures. For example, injection controller 146 in conjunction with components in wellhead 102 and test tool 110 may set and maintain the injection flow rate and/or flow pressure below the fracture pressure of formation 117 and further to remain below the static wellbore pressure within the isolated test zone.

Based on the adapted injection procedure, pump and valve control signals are transmitted via communications interface 138 to the control interfaces of pumps 168 and 170 and valves 162, 164, and 166 to implement coordinated flow of fluids from fluid sources 154, 156, and 158 through test string 104 at specified flow rates and/or pressures. Flow control components 120 within test tool 110 may be utilized to facilitate implementation of the specified flow rates and pressures such as by flow rate and/or flow pressure throttling. Additionally or in the alternative, flow rates and pressures may be controlled by directing the injection fluid to one or more pumps within test tool 110 that may regulate flow rate locally. In some embodiments, measurement instruments 128 and flow control components 120 may operate in conjunction to maintain relatively precise downhole control of the flow rates and pressures. For instance, measurement instruments 128 may include components for measuring the injection fluid flow rate and or flow pressure and one or more of flow control components 120 such as pumps and adjustable valves may be configured to modify flow rate and/or pressure accordingly. Such throttling control functionality may be implemented by flow control devices such as pumps, valves, and local controllers within test tool 110. The flow rate measurement may be calibrated downhole using the known flowrate of a pump for an injection fluid. The calibration may include at least one of a single known flow rate, a static measurement (no flow), and/or multiple known flow rates. The flow rates including a static measurement may be achieved with a pump such as a metered pump for reference. Thereby if at a later time the pump is bypassed, the flow measurement still provides a in situ calibrated value. The flow device may comprise the combination of two pressure gauges at two different locations within the flow line of the BHA. If two pressure gauges are used, a measured or known density of the injection fluid may be utilized to correctly account for gauge offset.

Injection controller 146 is configured to begin the injection procedure following a fluid intake phase or otherwise when the formation fluid pressure within the isolated test zone returns to steady-state formation reservoir pressure. The steady-state pressure condition may be determined by test tool 110, which may transmit a corresponding signal to DPS 140. To implement and regulate the pressurized application of the injection fluid, flow control and injection fluid selection/mixing instructions generated by injection controller 146 are transmitted to corresponding flow control components. In response to the instructions, the flow control components, such as pumps 168 and 170 and valves 162, 164, and 166 drive instruction-specified quantities of fluids from fluids sources 154, 156, and 158 into test string 104 at instruction-specified intervals corresponding to specified injection volumes. The fluids are transported via test string 104 into and through flow conduits and outlet ports within test tool 110. The injection flow rate may be maintained at a constant rate, which if not feasible, may be compensated for during post-processing using formation model tool 150.

The volume of injection fluid applied during the fluid injection test may depend on formation reservoir properties with respect to the intended reservoir extent to be monitored and the accuracy of the pressure detectors (e.g., pressure gauges) within test tool 110. For example, in 1000 millidarcy (md) formations having fluids at approximately 0.5 centipoise (cp), approximately 175 barrels of injection fluid is required to detect pressure/permeability barriers such as barriers 137*a*-137*c*, positioned up to 500 meters from the wellbore. This calculation may depend on the type of formation model used and may be analytically estimated or estimated by forward modeling simulations such as may be performed by a numerical formation modeling tool 150. The volume calculation may also be determined based on empirical methods or analogous comparison to offset wells located within a specified distance.

During injection of the injection fluid through test string 104 as throttled by test tool 110, the flow rate and wellbore pressure within the isolated test zone are measured by measurement instruments 120. Injection concludes with a sudden stoppage of the injection fluid flow with secondary plug 172 released from a surface holder into test string 104. Secondary plug 172, like wet latch 116, may include brush contacts or elastomeric contacts at its outer edges that contact the inner surface of the conduit within test string 116 and brush contacts or elastomeric contacts on the edge of the center hole through which wireline 114 passes. In this manner, secondary plug 172 keeps the injection fluid separate from driving secondary plug 172 in order to sweep test string 104 free of the injection fluid. In some embodiments, the action of secondary plug 172 reaching the bottom of wet latch 116 would both stop the flow of injection fluid into the formation and divert the drilling fluid flow into the annular region outside test string 104 and test tool 110. Test tool 110 transmits a signal to DPS 140 to initiate the substantially simultaneous deactivation of pumps 168 and 170.

In some embodiments multiple plugs may be used to separate multiple injection fluids. The plugs may be preloaded into the conduit system and deployed on demand. Alternatively, a liquid plug may be used in vertical or deviated wells. Such a liquid plug may have the advantage that it may be more easily deployed on demand and without substantial limit to the number of plugs used. Such a liquid plug would preferably have a density between that of the drilling fluid and the injection fluid, or between densities of subsequent injection fluids. The ideal fluid would not be soluble in either fluid being separated. Examples of such fluids include fluorocarbons, oils, or water. The density of such liquids may be adjusted to meet the specified criteria. The density of water may be raised with salts or lowered with compounds such as salts including but not limited to organic salts, or highly water-soluble organic compounds such as methanol, other alcohols.

Following stoppage of fluid injection, a pressure transient within the isolated test zone in the form of a pressure fall is detected and recorded by measurement instruments 120. Specifically, pressure at the sand face within the isolated test zone will decrease toward reservoir pressure as the injection fluid dissipates within the formation. The pressure drop information is transmitted by test tool 110 to DPS 140 and processed by formation modeling tool 150 to determine formation properties such as formation permeability and flow discontinuities (also referred to as pressure discontinuities or permeability discontinuities) such as discontinuities 137*a*-137*c*.

Formation model tool 150 processes the pressure drop transient detected subsequent to injection similar to the processing of pressure rise information for the intake test but with a fluid (the injection fluid) that is not an exact match in terms of one or more properties such as viscosity and density with the formation fluid. By minimizing the differences, particularly in viscosity, between the injection fluid and the formation fluid, the mathematical processing becomes increasingly similar to that of a fluid intake DST. However, forward modeling a formation simulation may allow interpretation of the pressure rebound to include differences in fluid properties. In some embodiments, laboratory data from the sampled fluid from the fluid intake test or another source may provide more accurate fluid properties with which to interpret the fluid intake test formation properties results. A fluid compositional gradient defined by formation testing data, or multiple formation testing samples, may also be used with forward model reservoir simulations in order to more accurately interpret the extent of the reservoir and internal reservoir flow barriers based on the determined permeability/pressure barriers. The gradient also may provide possible near wellbore damage (skin effect). Forward modeling may include analytical test design and interpretation of pressure derivative and superposition plot or numerical simulation of the whole process. Combining all data into numerical and analytical modeling also provides an overall estimate of the well performance (injectivity/productivity) and possible fluid displacement dynamic near the wellbore.

While formation test system 100 is described as being deployed for determining formation properties such as permeability, capacity, and naturally occurring discontinuities such as formation boundaries and internal material discontinuities, it should be noted that system 100 may also be operable for fracture analysis testing in which a fracture is intentionally created and tested. Such procedures are typically called a minifrac and can be analyzed using leakoff or flowback pressure transients to determine the fracture initiation, propagation, closure pressure (minimum horizontal stress), fracture half-length, and other formation properties such as permeability.

In some embodiments, test tool 110 includes a fluid intake port or probe located outside as well as within the isolated test zone. For example, a monitor probe may be located along wellbore 107 within one of the barrier zones between one of packers 130 and a proximate one of packers 132. Prior to injection of the injection fluid within the isolated test zone, the isolated buffer zone containing the monitor probe may be primed to make hydraulic contact from/with the formation that is a difference from the isolated buffer zone that is not primed. Differential pressure information obtained from the monitored buffer zone and the test zone may be processed by components of test tool 110 and/or DPS 140 to measure or otherwise determine formation anisotropy during or after the fluid injection test.

In the embodiment depicted in FIG. 1, the isolated buffer zones between packers 130 and 132 can be monitored such as by measurement instruments the measure properties of fluid withdrawn by flow ports 129 to detect pressure transients. This may require an initial test to determine a pressure difference between at least one of the buffer zones and the isolated test zone with an intake of formation fluid or injection of fluid followed by a shutin to establish hydraulic communication with the formation. Once the pressure has stabilized in the buffer zone(s) and the test zone, the extended injection test can start. During the extended injection, testing the pressures in the isolated buffer and test zones can be monitored to determine additional formation properties such as permeability anisotropy or near well bore structures such as layering and vertical flow barriers. Additional tests can be performed in the isolated buffer and test zones before or after the extended injection test and the pressures monitored in all isolated zones for further analysis.

Figure 3:
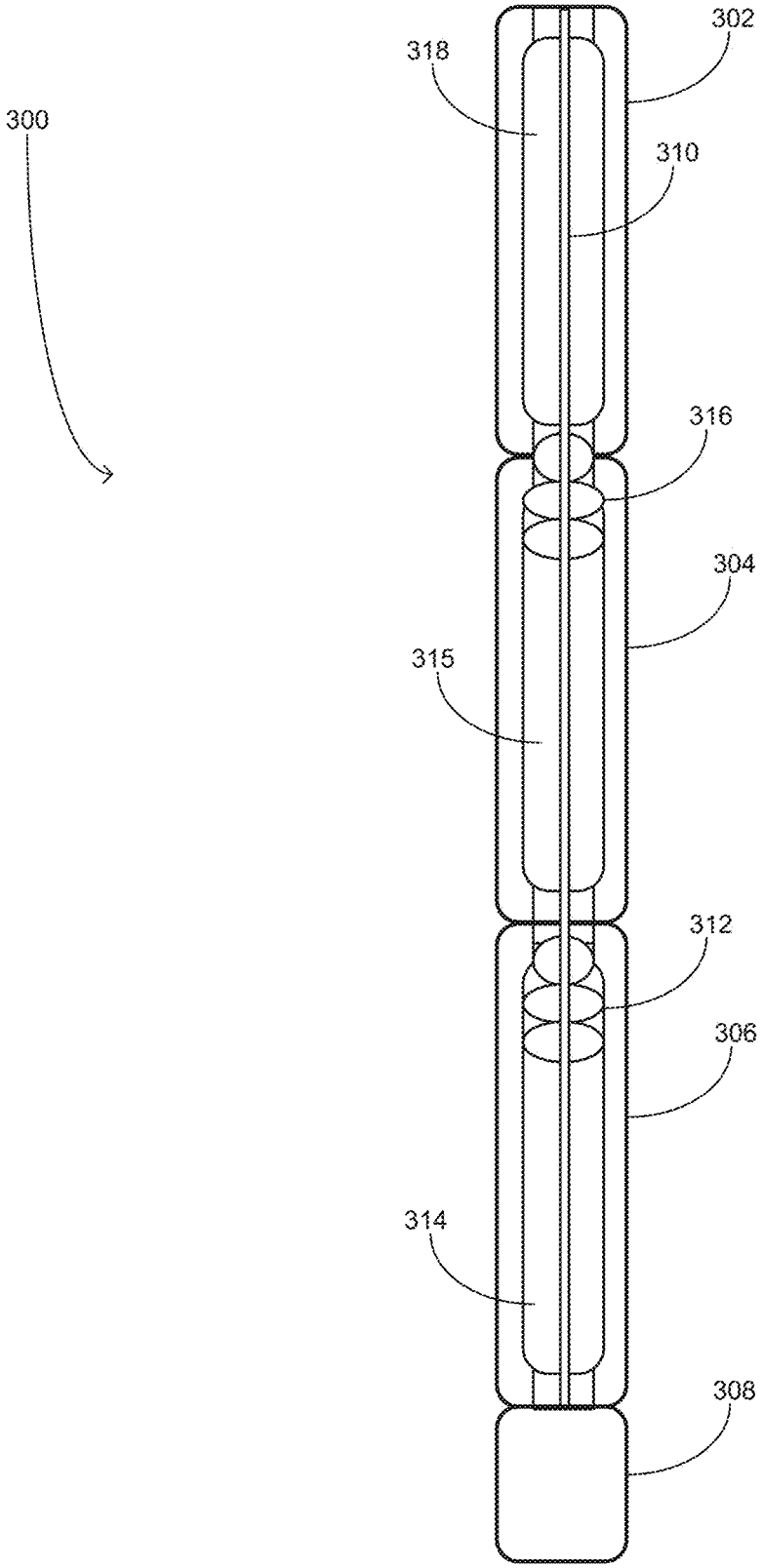
FIG. 3 illustrates an upper portion of a DST BHA in accordance with some embodiments.

As depicted and described with reference to FIG. 1 and in further detail with reference to FIGS. 3-5, movable plugs such as dart plugs may be inserted between fluids (e.g., between drilling fluid and injection fluid) to maintain optimal separation between the flows. The plugs may further be pressure actuated or otherwise controllably actuated when seated at a seating position within the flow path, thereby providing controlled timing release between each of the fluids. In this manner, the flow control signals in combination with the flow separation plugs within the flow path within test string 104 and/or connection section 112 enable sequential separation of fluid transport to the isolated test zone.

The connection section and test tool components, represented in FIG. 1 as connector section 112 and test tool 110, may be implemented as a DST BHA in a variety of configurations. FIG. 3 illustrates an upper portion 300 of an example DST BHA in accordance with some embodiments. The upper portion 300 of the DST BHA includes drill pipe sections 302, 304, and 306 that are interconnected such as by direct or intermediary connector threaded connection or other mechanical connection means. A connector section 308 is connected to the other end of drill pipe section 304 also by convention connectivity means such as threaded connection. Drill pipe sections 302, 304, and 306 form a portion of a test string such as test string 104 in FIG. 1. While the depicted pipe sections 302, 304, and 306 are discrete straight pipe components, it should be noted that a test string utilized for implementing formation testing as described herein may be configured as a coiled tubing or other materially contiguous fluid conduit component.

Several flow control components and fluids for implementing formation testing are depicted within drill pipe sections 302, 304, and 306. A wireline cable 310 that is representative of or otherwise equivalent to wireline 114 is disposed within the conduit formed along drill pipe sections 302, 304, and 306. A first sealing plug 312 has been hydraulically driven through the conduit to a position within drill pipe section 306 at which first sealing plug 312 separates drilling fluid 314 that is present within the test string prior to fluid intake testing from injection fluid 315. In some embodiments, first sealing plug 312 is representative of or otherwise equivalent to wet latch 116. Based on a dual phase flow test sequence, a second sealing plug 316 has been hydraulically driven through the conduit to a position within drill pipe section 304 at which second sealing plug 316 separates injection fluid 315 from drill fluid 318 that is utilized to sweep injection fluid 315 from the test string, connector section 308, and test tool (not depicted).

Figure 4:
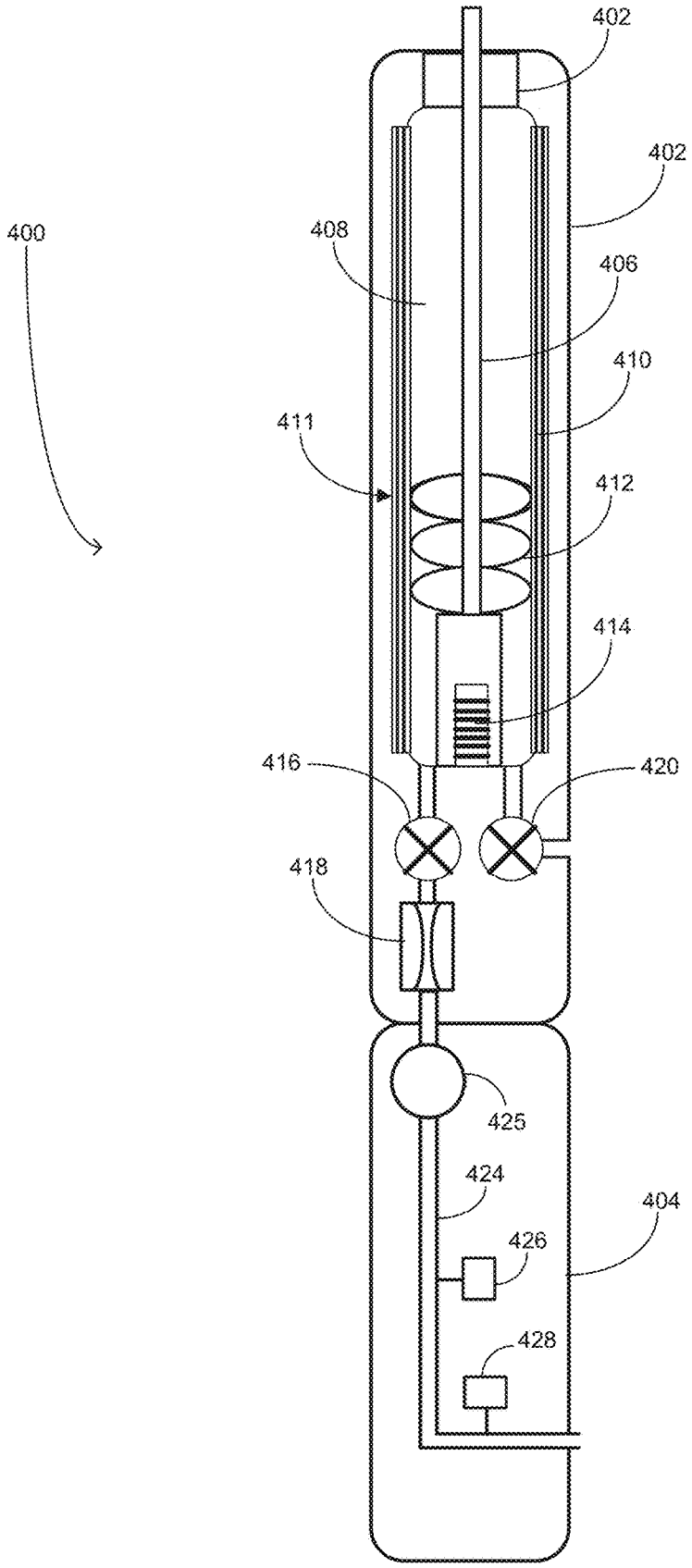
FIG. 4 depicts a DST BHA in accordance with some embodiments.

FIG. 4 depicts an example DST BHA 400 in accordance with some embodiments. The DST BHA 400 includes a connector section 402 that is mechanically connected such as by direct or intermediary threaded connection with a formation test tool 404. Connector section 402 is representative of or otherwise equivalent to connector section 116 and includes a sealing plug receptacle 411 into which a sealing plug 412 is seated after being driven by hydraulic pressure applied to a volume of injection fluid 408. Sealing plug 412 provides a fluid barrier function of separating the drilling fluid (not depicted) from injection fluid 408 and also serves as a wet latch for connecting an interface of a wireline 406 with test tool 404 by seating the wireline interface within an electrical connector 414. Sealing plug receptacle 411 further incudes a bypass screen 410 that is configured along or on combination with other flow routing components such as valves 416 and 420 to route intake fluid originating from outside the test tool 404 and injection fluid or drilling fluid driven into connector section 402.

Bypass screen 410 may be a single or multi-layer filter through which fluid may flow from the upper portion of the fluid conduit formed with connector section 402. For embodiments in which drilling fluid filtrate is used as the injection fluid, the wellhead may pump drilling fluid through the conduit formed by the test string and down to connector section 402 where it enters the lower injection conduit through bypass screen 410. Bypass screen 410 is configured to remove particulates and/or liquid components from the drilling mud or other fluids. For example, the removal of particulates from oil base or aqueous drilling mud may result in generation of a suitable injection fluid in the form of an aqueous or non-aqueous base fluid.

Injection fluid 408 may be released via flow valve 416 and through a flow controller 418 that regulates flow rate and/or pressure during injection. In some embodiments flow controller 418 includes an adjustable nozzle that may be controlled via a downhole controller to adjust flow rate. Flow controller 418 may further include a flow measurement component configured to measure flow rate and meter flow in either direction.

DST BHA 400 is further configured to measure or otherwise determine injection flow rates and volumes as well as injection fluid properties such as viscosity using pressure measurement components within test tool 404. In addition or alternatively to flow rate control modulated via measurements by flow controller 418, DST BHA 400 may be configured to regulate injection flow using flow rate values determined by differential fluid pressure measurements within test tool 404. As shown, test tool 400 includes a pair of pressure gauges 426 and 428 each configured to measure fluid pressure along the length of an injection conduit 424. Pressure gauges 426 and 428 may, for example, comprises quartz gauges, venturi devices, etc. Pressure gauges 426 and 428 may be positioned at different heights along conduit 424 with gauge 426 located at a higher position that gauge 428.

In some embodiments, test tool 404 includes a metered flow pump 425 that pumps fluid through injection conduit 424 at a known flow rate. Viscosity of the injection fluid may vary for some injection operations in which temperature and pressure may vary during downhole operation. Viscosity of the injection fluid may be calculated based on the flow cross-section area of conduit 424, a difference in pressures measured by gauges 426 and 428, and the metered flow rate from pump 425. Furthermore, the known flow rate can be used to calibrate a pressure difference (e.g., a pressure drop) between pressure gauges 426 and 428.

For some embodiments, the flow rate may not be a known value such as when pump 425 is fully or partially bypassed for injection operations. Given an injection fluid having a known viscosity and a known flow cross-section area through conduit 424, a flow rate can be determined based on pressure measurements by pressure gauges 426 and 428. In some embodiments, the flow rate through injection conduit may be calculated based on the injection fluid viscosity, the flow cross-section area, and a difference in the pressures measured by gauges 426 and 428 during injection. Pressure gauges 426 and 428 may be further utilized to correct for measurement offset that may be caused by different fluid densities and a difference in absolute height between the locations of gauges 426 and 428. For example, during a no flow condition (i.e., no net flow through conduit 424), a static pressure differential may be determined from gauges 426 and 428.

Figure 5:
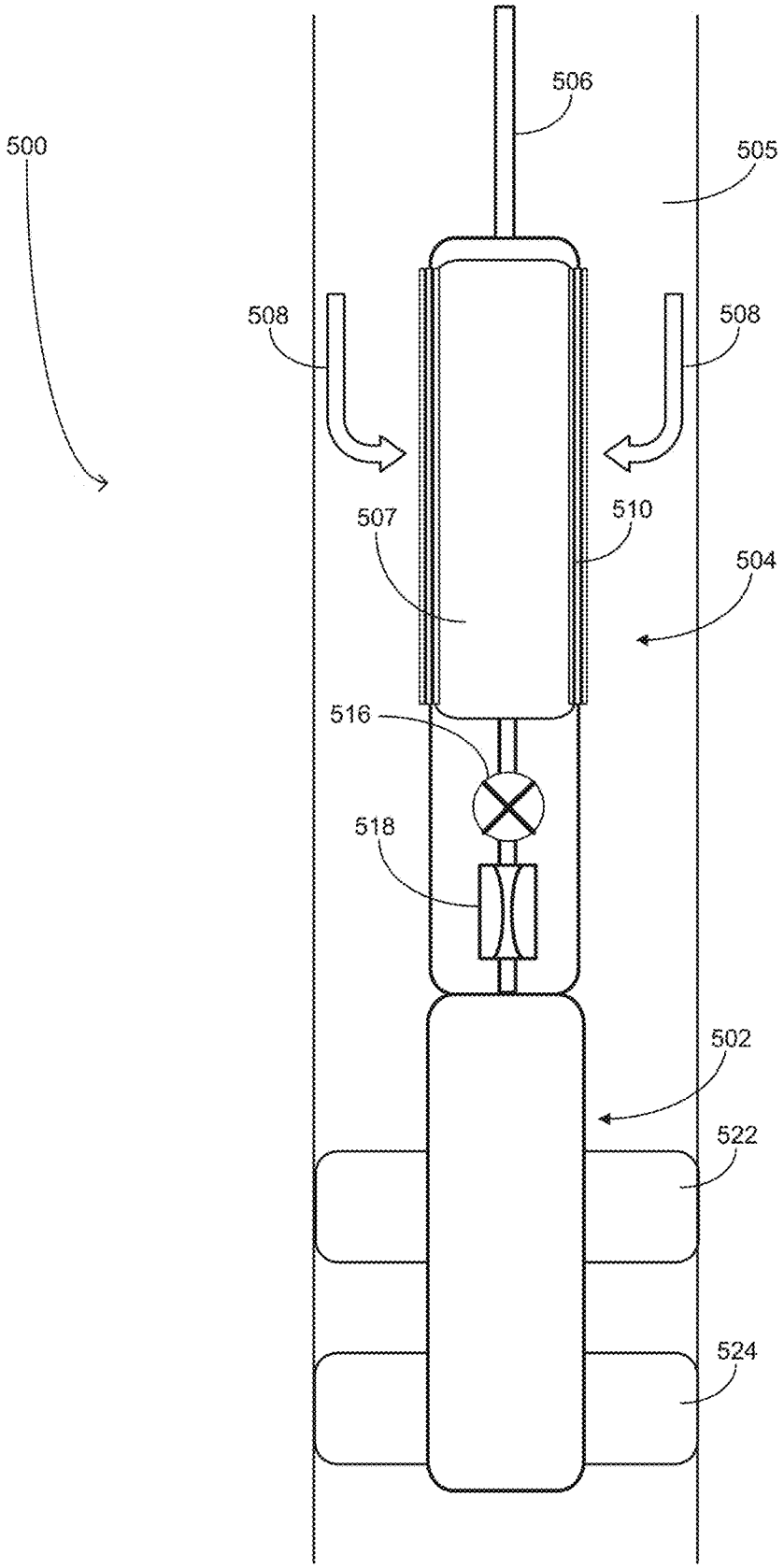
FIG. 5 illustrates a DST string that may be implemented in a wireline configuration in accordance with some embodiments.

FIG. 5 illustrates a DST string 500 that may be implemented in a wireline configuration in accordance with some embodiments. DST string 500 is disposed in a wellbore 505 and positioned via a wireline cable 506 to various test positions within wellbore 505. DST string 500 includes a test section 502 that as depicted and described with reference to FIGS. 1, 3, and 4 may include multiple components contained within one or more distinct housings. The components within test section 502 may include flow control devices coupled to flow ports configured to withdraw and injection formation fluids, drilling fluids, and/or injection fluids. For embodiments in which the flow ports comprise open ports that do not form a seal with the wellbore wall, the flow control devices and ports are configured to withdraw and inject fluids from and into the isolated zone within wellbore 505 between packer 522 and 524. For embodiments in which the flow ports comprise extendable probes such as depicted in FIGS. 2A, 2B, and 2C, the flow control devices and ports are configured to withdraw and inject fluids from and into (at or below the surface of) the borehole wall of wellbore 505.

DST string 500 is configured to utilize an upper portion of wellbore 505 as a portion of the conduit that transports injection fluid from the surface to the ports within test section 502 such that a non-enclosed wireline configuration may be implemented. DST string 500 includes an injection control section 504 attached above formation test section 502. Injection control section 504 comprises a body having an input port disposed thereabout in the form of a filter screen 510. Filter screen 510 may be a single or multi-layer filter through which fluid may flow between wellbore and the interior fluid containment and conduit of injection control section 504. A wellhead system such as depicted in FIG. 1 may be configured to pressurize wellbore 505 such as by application of downhole and surface pump pressure and/or by filling wellbore 505 with drilling mud or other fluid to induce a downward pressure. In some embodiments, wellbore 505 may be at least partially filled and sealed at surface to establish a baseline injection pressure. Surface and/or downhole pumps may implement a controlled pumping based on downhole pressure, flow rate, and/or flow volume measurements to modulate the injection pressure/flow rate. Per one or more of these pressurized flow techniques, a flow may be established from surface and into injection control section 504 via wellbore 505.

Injection control section 504 is further configured to control and measure flow rate of fluids between wellbore 505 and formation test section 502. Injection control section 504 includes a flow direction valve 516 configured to determine the direction of flow either from wellbore 505 or into wellbore 505. For instance, during an injection operation, a positive pressure may be applied to wellbore 505 and flow direction valve 516 may be set to permit downward flow into formation test section 502. The downward pressure may be set within a range above downhole hydrostatic pressure and above formation fluid pressure with the net pressure overbalance used for injection. During a fluid intake operation, a negative pressure may be applied within wellbore 505 and flow direction valve 516 set to permit upward from formation test section 502 into wellbore 505. Injection control section 504 further includes a flow controller 518 configured to adjust the flow rate into and from formation test section 502. The flow rate may be controlled by regulating the pressure differential between the non-isolated upper wellbore 505 and formation pressure within the isolation zone between packers 522 and 524. In some embodiments flow controller 518 may include an adjustable nozzle that may be controlled via a downhole controller to adjust flow rate. Flow controller 518 may further include a flow measurement component configured to measure flow rate and meter flow in either direction.

The depicted embodiment may be configured to generate suitable injection fluid from wellbore fluids that may include an unsuitable composition of liquid and solid particulate components. For example, a wellhead system may pump or otherwise pressuring a drilling mud 508 flow downward to injection control section 504. Filter screen 510 includes one or more filter layers configured to remove particulates and/or liquid components from the drilling mud as the drilling mud flows into injection control section 504. For example, the removal of particulates may result in a base fluid 507 flowing into and through injection control section 504 to be used during an injection operation. The composition of base fluid 507 depends on the content of drilling fluid 508 and configuration of filter screen 510. For embodiments in which an oil base drilling fluid is used, filter screen 510 is configured to remove particulates and other injection fluid contaminants such as aqueous components. For embodiments in which a water base drilling fluid is used, filter screen 510 is configured to remove particulates and other injection fluid contaminants such as non-aqueous liquid components.

The numbers of filter layers, filter layer materials, and filter mesh size (e.g., screen gauge) may depend on the type of drilling mud and the selected injection fluid composition. To maximize continuous downhole operation, DST string 500 may be configured to implement a filter cleaning mode in which a downhole pump within formation test section 502 is reversed or otherwise configured to apply a positive upward pressure through injection control section 504 to remove particulates that may have collected on the exterior surface(s) of filter screen 510.

Figure 6:
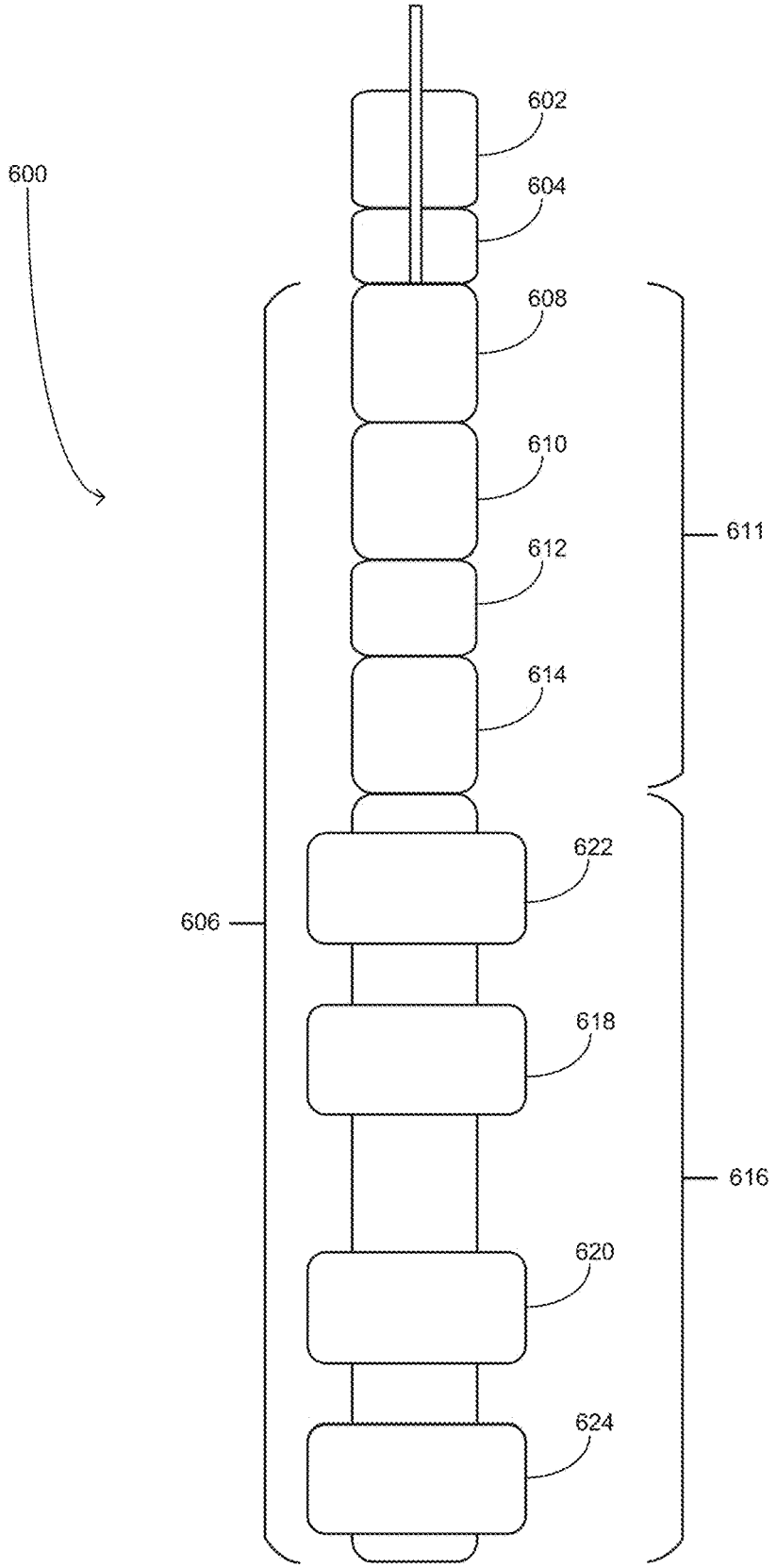
FIG. 6 illustrates a DST BHA in accordance with some embodiments.

FIG. 6 illustrates an example DST BHA 600 in accordance with some embodiments. DST BHA 600 includes a drill pipe section 602 that is mechanically connected such as by direct or intermediary threaded connection with a connector section 604. Connector section 604 is representative of or otherwise equivalent to either of connector sections 116 and 402 and is mechanically connected such as by direct or intermediary threaded connection with a formation test tool 606. Test tool 606 is representative of or otherwise equivalent to test tool 110 and includes an upper section 611 comprising a first pump section 608, a sampling section 610, a fluid ID section 612, and a second pump section 614. First pump section 608 comprises fluid pump components for driving liquids and/or gases. For example, pump section 608 may be configured to provide negative pressure in an isolated test zone during a formation fluid intake phase and/or to drive injection fluid during a fluid injection phase. Pump section 608 may be further configured to inflate packers to create an isolated test zone and surrounding isolated buffer zones. Sampling section 610 comprises components configured to capture and store samples of formation fluid such as during a fluid intake test phase. Fluid ID section 612 comprises components configured to analyze formation fluid composition such as the composition of fluids captured by sampling section 610.

Formation test tool 606 further includes a lower packer probe section 616 that includes inflatable packers 618 and 620 that when inflated form a hydraulically isolated test zone between packers 618 and 620. Packer probe section 616 further includes inflatable packers 622 and 624 that when inflated form two additional hydraulically isolated buffer zones, one between packer 622 and 618 and the other between packer 624 and packer 620. As explained with reference to FIG. 1, the buffer zones may be probes to provide information to cancel or diminish the effects of pressure fluctuations in the wellbore on the pressure measurements performed in the isolated test zone. For this purpose, an additional fluid pump may facilitate the process. In the depicted embodiment, the second pump section 614 within upper section 611 includes fluid pump components that may be used as a backup or to increase flow rates such as increased intake flow rates for focused sampling, and also as a pumping source for the barrier zones. During fluid intake sampling and flushing of the isolated test zone, pump section 614 may be utilized to pump from the isolated buffer zones, focusing the fluid to the isolated test zone to improve quality in terms of lower contamination of the sample being pumped by pump section 614. In some embodiments, during the injection phase, the tool pumps may be bypassed entirely so that the pressure is built from surface pump 168.

Figure 7:
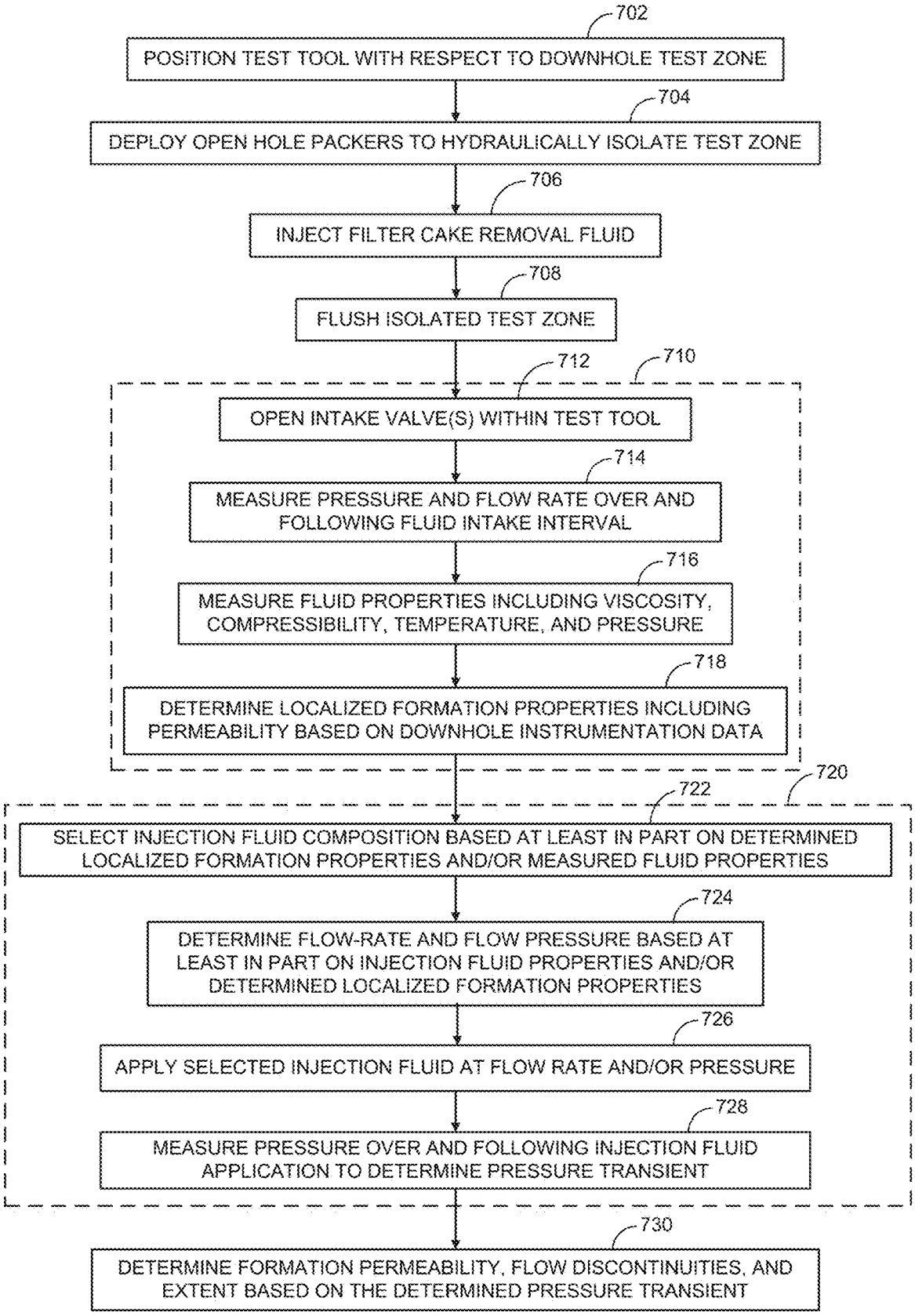
FIG. 7 is a flow diagram depicting operations and function for implementing formation testing in accordance with some embodiments.

FIG. 7 is a flow diagram depicting operations and function for implementing formation testing in accordance with some embodiments. The operations and functions depicted and described with reference to FIG. 7 may be performed by any of the systems, devices, and components depicted and described with reference to FIGS. 1-6. Formation testing begins as shown at block 702 with a wellhead system such as wellhead 102 extending or retracting a test string within a wellbore to position a DST BHA connected to the end of the test string. The DST BHA includes a test tool comprising flow control components such as pumps and valves and also includes measurement instruments for measuring properties of fluids withdrawn into the test tool through probes and/or surface ports. When the DST BHA is positioned proximate to a test position within the wellbore a pump or other component is utilized to deploy isolation packers to form a hydraulically isolated test zone (block 704).

At block 706, flow control components within the test tool in coordination with a surface flow control system drive filter cake removal fluid into the isolated test zone. During this operation, flow may be allowed into the test tool at other ports (e.g., those shown as 122, 124 or 129 in FIG. 1) to enable the simultaneous flushing of the isolated zone wellbore. In some embodiments, the filter cake removal fluid may comprise an injection fluid base that further includes components for facilitating removal of filter cake. In some embodiments, following the injection of the filter cake removal fluid, the isolated test zone is flushed such as by pumping and otherwise evacuating the fluid content of the isolated test zone (block 708).

A fluid inflow test phase is executed as implemented by the operations within superblock 710. At block 712, the system actuates flow control devices such as pumps and valves to induce negative pressure that induces fluid flow from the isolated test zone into probes or ports within the test tool. At block 714, test tool measurement components measure fluid pressure and flow rate into the test tool during and following the intake fluid flow interval. For example, test tool may measure the pressure within the isolated test zone following termination of the intake fluid flow to determine a pressure rise transient that occurs in the isolated test zone as the formation reservoir pressure returns to equilibrium. As shown at block 716, the test tool is also configured to measure fluid properties including but not limited to viscosity, compressibility, bubble point, and material composition. The fluid properties determined at blocks 714 and 716 may be transmitted to a surface data processing system for additional processing. At block 718, components in the test tool and/or surface data processing system determine formation properties including formation permeability and static pressure based on the collected data. In some embodiments, the operations within superblock 710 may be repeated at multiple depth positions within the wellbore and the measured fluid and formation properties utilized to select a test position for performing an injection flow test. Additionally, or in the alternative, the formation and fluid data from the multiple fluid intake tests may be utilized with at least one of a fluid sample analysis and downhole fluid measurement to map fluid variation within the formation reservoir.

An injection fluid test phase is executed as implemented by the operations depicted within superblock 720. At block 722, test controller component such as injection controller 146 and/or other system components select or produce an injection fluid having a material composition and fluid properties such as viscosity based, at least in part, on the formation properties determined at block 718 and/or fluid properties determined at block 716. At block 724, the test controller determines flow rate and/or flow pressure to be applied during injection of the injection fluid into the isolated test zone. The test controller may determine the flow rate and/or flow pressure based, at least in part, on the properties, such as viscosity, of the selected injection fluid and/or on the formation properties determined at block 718. At block 726, the controller in conjunction with surface flow control devices and flow control devices within the test tool apply the selected injection fluid at the flow rate or pressure determined at block 724 for a period corresponding to a selected injection fluid volume. The fluid injection test phase concludes as shown at block 728 with the test tool measuring fluid pressure within the isolated test zone following termination of fluid injection. The test tool measures a pressure rise transient for a period following fluid injection until the formation reservoir pressure reaches steady state equilibrium. The overall test cycle concludes as shown at block 730 with test controller components such a formation model tool processing the pressure transient data measured at block 728 to determine formation properties such as permeability, the locations of flow discontinues, and the geometric and capacity extent of the formation reservoir.

Figure 8:
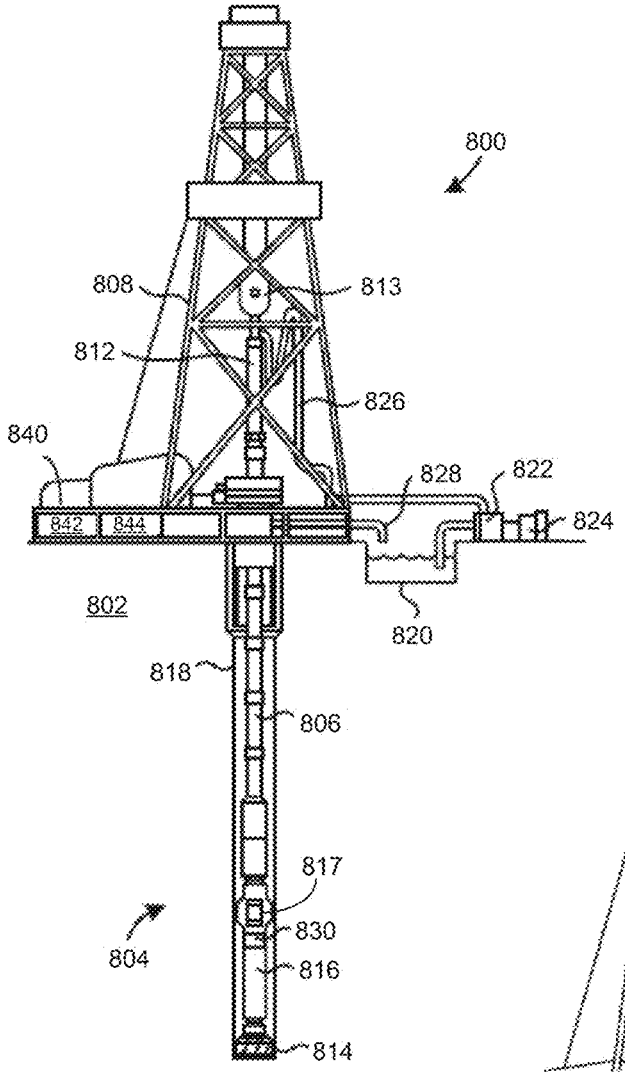
FIG. 8 illustrates a drilling system in accordance with some embodiments.

FIG. 8 illustrates a drilling system 800 that may be utilized to deploy DST tools and potentially other logging tools in accordance with some embodiments. Drilling system 800 is configured to include and use DST components for measuring properties of a formation and downhole material such as downhole fluids. The DST components within a tool string 816 may be utilized to collect formation properties data in either a drilling configuration as depicted in FIG. 8 and/or in a non-drilling configuration in which drill piping is used such as depicted in FIG. 1. In the depicted drilling configuration, the DST components are deployed and operated within a tool string 816 that is coupled to an upper portion of drill pipe in a drill string 806 that terminates in a drill bit 814. The DST components within tool string 816 may complement logging tools 817 also deployed by drilling system 800 for collecting test data via measurement-while-drilling (MWD) and/or a logging-while-drilling (LWD) operations. In such embodiments, MWD and/or LWD logging data may be collected by logging tools 817 during and between drilling operation intervals. Between drilling operation intervals during which drill string 806 is relatively stationary, the DST components within tool string 816 may be utilized to collect formation properties data.

Drilling system 800 may be configured to drive a bottom hole assembly (BHA) 804 positioned or otherwise arranged at the bottom of drill string 806 extended into the earth 802 from a derrick 808 arranged at the surface 810. Derrick 808 may include a kelly 812 and a traveling block 813 used to lower and raise kelly 812 and drill string 806. BHA 804 may include drill bit 814 operatively coupled to tool string 816 that may be moved axially within a drilled wellbore 818 as attached to the drill string 806. During operation, drill bit 814 penetrates the earth 802 and thereby creates wellbore 818. BHA 804 may provide directional control of drill bit 814 as it advances into the earth 802. Tool string 816 can be semi-permanently mounted with various measurement tools such as, but not limited to, the DST tools and components depicted in FIGS. 1, 3, 4, and 6. In some embodiments, the DST tools and components may be self-contained within tool string 816, as shown in FIG. 8.

Fluids such as drilling fluid and/or injection fluid from a fluid tank 820 may be pumped downhole using a pump 822 powered by an adjacent power source, such as a prime mover or motor 824. For example, a drilling fluid may be pumped from the tank 820, through a stand pipe 826, which feeds the drilling fluid into drill string 806 and conveys the same to drill bit 814. The drilling fluid exits one or more nozzles arranged in drill bit 814 and in the process cools drill bit 814. After exiting drill bit 814, the drilling fluid circulates back to the surface 810 via the annulus defined between wellbore 818 and drill string 806, and in the process, returns drill cuttings and debris to the surface. The cuttings and mud mixture are passed through a flow line 828 and are processed such that a cleaned drilling fluid is returned down hole through stand pipe 826. During injection operations, injection fluid may be pumped from tank 820 or another source through all or a portion of the surface and downhole drilling fluid conduits such as stand pipe 826 and drill string 806. The injection fluid passes through drill string 806 and into fluid injection components such as flow control devices and fluid ports within tool string 816.

Tool string 816 may further include a measurement tool 830 similar to the measurement instruments 128 described with reference to FIG. 1. Measurement tool 830 may be configured to measure, detect, or otherwise determining properties of the intake fluid flow and fluid property metrics for wellbore fluids and for detecting fluid pressure within wellbore 818 during injection testing. Measurement tool 830 may be controlled from the surface 810 by a computer 840 having a memory 842 and a processor 844. Accordingly, memory 842 may store commands that, when executed by processor 844, cause computer 840 to perform at least some steps in methods consistent with the present disclosure.

Figure 9:
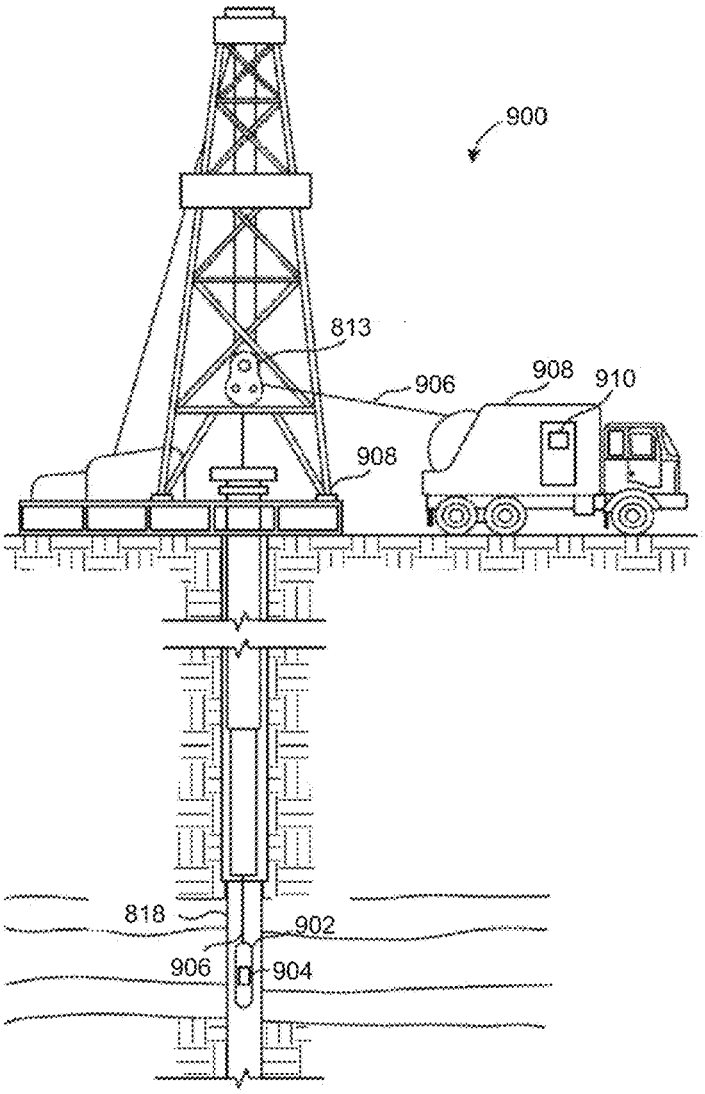
FIG. 9 depicts a wireline logging system in accordance with some embodiments.

FIG. 9 illustrates a wireline system 900 that may employ one or more principles of the present disclosure. In some embodiments, wireline system 900 may be configured to use a formation test tool deployed within a DST string. After drilling of wellbore 818 is complete, it may be desirable to determine details regarding composition of formation fluids and associated properties through wireline sampling. Wireline system 900 may include a DST string 902 that forms part of a wireline deployment and operation of a DST string that can include one or more DST components 904, as described herein. Wireline system 900 may include the derrick 808 that supports the traveling block 813. DST string 902, similar to the depicted DST strings and BHAs shown FIGS. 1 and 3-6, may include components such as a probe or sonde, may be lowered by a wireline cable 906 into wellbore 818.

DST string 902 may be lowered to potential production zone or other region of interest within wellbore 818 and used in conjunction with other components such as packers and pumps to perform well testing and sampling. More particularly, DST string 902 may include test tool 904 comprising components such as those depicted with reference to test tool 110 in FIG. 1 and with reference to DST string 500 in FIG. 5 arranged therein. Test tool 904 may be configured to measure formation properties including formation fluid properties, and any measurement data generated by DST string 902 and formation test tool 904 can be real-time processed for decision-making, or communicated to a surface logging facility 908 for storage, processing, and/or analysis. Logging facility 908 may be provided with electronic equipment 910, including processors for various types of data and signal processing including perform at least some steps in methods consistent with the present disclosure.

Example Computer

Figure 10:
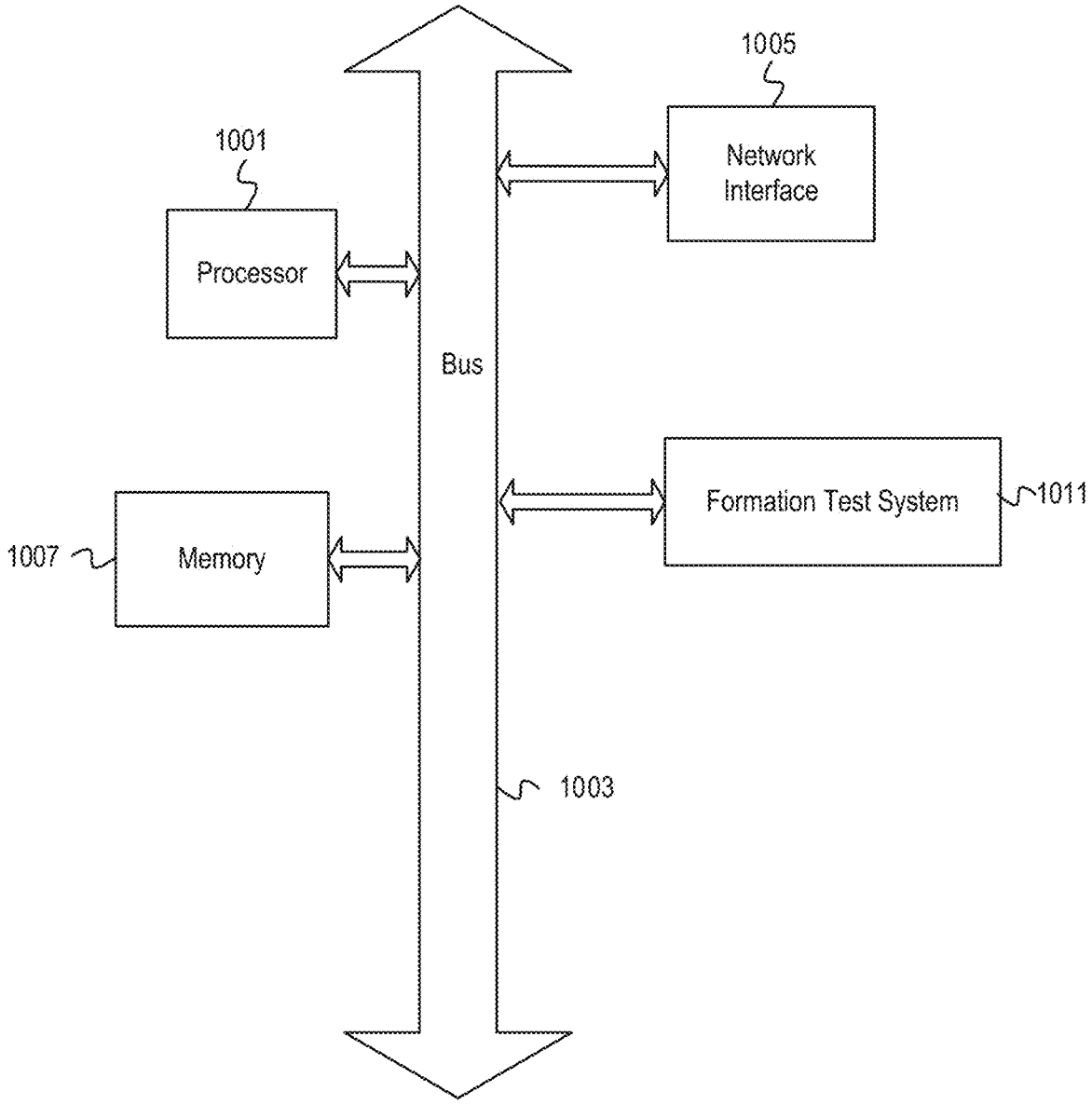
FIG. 10 depicts a computer system for implementing aspects of formation testing in accordance with some embodiments.

FIG. 10 is a block diagram depicting an example computer system that may be utilized to implement control operations for implementing a formation testing operation in accordance with some embodiments. The computer system includes a processor 1001 (possibly including multiple processors, multiple cores, multiple nodes, and/or implementing multi-threading, etc.). The computer system includes a memory 1007. The memory 1007 may be system memory (e.g., one or more of cache, SRAM, DRAM, etc.) or any one or more of the above already described possible realizations of machine-readable media. The computer system also includes a bus 1003 (e.g., PCI, ISA, PCI-Express, InfiniBand® bus, NuBus, etc.) and a network interface 1005 which may comprise a Fiber Channel, Ethernet interface, SONET, or other interface.

The system also includes a formation test system 1011, which may comprise hardware, software, firmware, or a combination thereof. Formation test system 1011 may be configured similarly to data processing system 140 and/or injection controller 146 and/or formation model tool 150 in FIG. 1. For example, injection control system 1011 may comprise instructions executable by the processor 1001. Any one of the previously described functionalities may be partially (or entirely) implemented in hardware and/or on the processor 1001. For example, the functionality may be implemented with an application specific integrated circuit, in logic implemented in the processor 1001, in a co-processor on a peripheral device or card, etc. Injection control system 1011 generates fluid flow control signals based, at least in part, on injection test procedure information and downhole fluid properties information collected during intake fluid flow testing and corresponding injection fluid flow testing. The flow control signals may be transmitted to flow control devices such as pumps and valves in the manner described above.

Variations

While the aspects of the disclosure are described with reference to various implementations and exploitations, it will be understood that these aspects are illustrative and that the scope of the claims is not limited to them. In general, techniques for implementing formation testing as described herein may be performed with facilities consistent with any hardware system or systems. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. Use of the phrase "at least one of" preceding a list with the conjunction "and" should not be treated as an exclusive list and should not be construed as a list of categories with one item from each category, unless specifically stated otherwise.

Example Embodiments

Embodiment 1: A method for determining properties of a formation comprising: performing a fluid inflow test within an isolation zone of a wellbore; determining a first formation property based, at least in part, on the fluid inflow test; and performing a fluid injection test within the isolation zone including applying an injection fluid into the isolation zone, wherein a flow parameter for the injection fluid application is determined based, at least in part, on the first formation property, and measuring pressure within the isolation zone to determine a pressure transient associated with the application of the injection fluid. The method may further comprise determining a second formation property based on the determined pressure transient. Said determining a second formation property may comprise determining at least one of a formation flow barrier, a reservoir extent, a reservoir geometry, a formation permeability, a formation porosity, and a formation anisotropy. Said performing the fluid inflow test may comprise withdrawing formation fluid from the isolation zone into the test tool, measuring a property of the withdrawn formation fluid, and determining a composition of the injection fluid based on the measured property. The method may further comprise detecting a pressure transient during said withdrawing formation fluid into the test tool, wherein said determining a first formation property comprises determining a permeability of the formation based on the detected pressure transient, and wherein said applying the injection fluid comprises injecting the injection fluid at a flow rate that is based, at least in part, on the determined permeability. The flow parameter may comprise at least one of a flow rate and a flow pressure. Said performing a fluid injection test may include determining an injection flow rate based on a differential pressure measurement. The method may further comprise selecting a fluid composition for the injection fluid based, at least in part, on the first formation property. Said determining the first formation property may comprise determining at least one of a formation pressure, a permeability, a temperature, and a fluid material property. The fluid material property may include at least one of a viscosity, a density, a wettability, a composition, a filtrate contamination, a compressibility, a bubble point, and a gas-to-oil ratio. The method may further comprise deploying a test tool to a test position within the wellbore, wherein the test tool is attached to a test string that forms a fluid conduit configured to transfer the injection fluid to the isolation zone, and wherein said deploying includes hydraulically isolating a portion of the wellbore proximate the test tool to form the isolation zone containing the test position. The method may further comprise applying an initial injection fluid within the isolation zone to clean at least a portion of an inner surface of the wellbore within the isolation zone prior to said performing the fluid inflow test, and wherein said performing a fluid injection test includes sequentially deploying one or more sealing plugs that separate at least two of a drilling fluid, the initial injection fluid, and the injection fluid.

Embodiment 2: A system for determining properties of a formation comprising: a test tool deployed within a wellbore; a formation test system that includes said test tool and is configured to: perform a fluid inflow test within an isolation zone; determine a first formation property based, at least in part, on the fluid inflow test; and perform a fluid injection test within the isolation zone including: applying an injection fluid into the isolation zone, wherein a flow parameter for the injection fluid application is determined based, at least in part, on the first formation property; and measuring pressure within the isolation zone to determine a pressure transient associated with the application of the injection fluid. The system may further comprise packers deployed proximate the test tool to hydraulically isolate a portion of the wellbore to form the isolation zone within which the test tool is disposed. The formation test system may be further configured to determine a second formation property based on the determined pressure transient. Said determining a second formation property may comprise determining at least one of a formation flow barrier, a reservoir extent, a reservoir geometry, a formation permeability, a formation porosity, and a formation anisotropy. The flow parameter may comprise at least one of a flow rate and a flow pressure. The formation test system may be configured to select a fluid composition for the injection fluid based, at least in part, on the first formation property. Said determining the first formation property may comprise determining at least one of a formation pressure, a permeability, a temperature, and a fluid material property. The formation test system may be further configured to apply an initial injection fluid within the isolation zone to clean at least a portion of an inner surface of the wellbore within the isolation zone prior to said performing the fluid inflow test, and wherein said performing a fluid injection test includes sequentially deploying one or more sealing plugs that separate at least two of a drilling fluid, the initial injection fluid, and the injection fluid.

What is claimed is:

1. A method comprising:

positioning a drill stem test tool at one or more test positions within a wellbore extending into a formation;

while positioned at each of the one or more test positions, deploying one or more isolation devices to isolate a test zone within the wellbore;

withdrawing a formation fluid from wellbore within the test zone, and pumping the withdrawn formation fluid into a non-isolated portion of the wellbore outside of the test zone;

pressurizing, using one or more pressurization devices, the formation fluid present in the non-isolated portion of the wellbore and proximate an injection control section of the drill stem test tool including pressurizing a column of drilling fluid located above the formation fluid within the non-isolated portion of the test zone; and filtering, using one or more filter layers, a flow of the formation fluid that is flowing into the injection control section of the drill stem test tool from the non-isolated portion of the wellbore, the one or more filter layers configured to remove particulates and/or liquid components from the flow of formation fluid in order to generate a filtered injection fluid for use during an injection operation performed on the one or more test positions where the one or more isolation devices have been deployed.

2. The method of claim 1, wherein the formation fluid present in the non-isolated portion of the wellbore includes filter cake that has been removed from the portion of the wellbore included within the test zone.

3. The method of claim 1, wherein the one or more isolation devices comprise a set of inflatable packers.

4. The method of claim 1, wherein the one or more isolation devices comprise one or more hydraulic probes.

5. The method of claim 1, further comprising:

actuating one or more flow control devices within the drill stem test tool to induce an inflow of fluid from the test zone where the drill stem test tool is deployed into the drill stem test tool and for an inflow period of time configured to remove a filter cake from an inner surface of the wellbore included within the test zone.

6. The method of claim 5, further comprising:

following the inflow period of time, performing a fluid injection procedure including injecting the filtered injection fluid into a portion of the wellbore isolated with the test zone.

7. The method of claim 6, further comprising:

determining a formation permeability based at least in part on a results obtained by performing the fluid injection procedure.

8. The method of claim 1, further comprising performing a filter cleaning mode including operating a downhole pump that is located within the drill stem test tool to generate a reverse flow of fluid through the one or more filter layers, the reverse flow of fluid configured to remove particulates that have collected on one or more exterior surfaces of the one or more filter layers.

9. An apparatus comprising:

a drill stem test tool including a test section coupled to an injection control section, the drill stem test tool configured to be positioned at one or more test positions within a wellbore that extends into a formation;

wherein the test section comprises one or more isolation devices configured to be deployed while the drill stem test tool is positioned at any one of the one or more test positions to create a test zone within the wellbore;

wherein the injection control section is configured to withdraw a formation fluid from within the test zone and to pump the withdrawn formation fluid into a non-isolated portion of the wellbore outside of the test zone;

wherein the injection control section comprises a body having an input port including a filter screen, wherein the input port is configured to provide fluid communication between the non-isolated portion of the wellbore outside of the test zone and an interior fluid section of the injection control section, and wherein the filter screen is configured to filter a pressurized flow of the formation fluid provided from the non-isolated portion of the wellbore at the input port in order to provide a filtered injection fluid to the injection control section, wherein the pressurized flow of formation fluid is configured to be provided through the pressurization of a column of a drilling fluid located above the formation fluid located within the non-isolated portion of the test zone; and wherein the injection control section is configured to perform one or more fluid injection tests at the test zone using the filtered injection fluid.

10. The apparatus of claim 9, wherein the filter screen is a single layer filter.

11. The apparatus of claim 9, wherein the filter screen is a multi-layer filter.

12. The apparatus of claim 9, wherein the formation fluid present in the non-isolated portion of the wellbore includes filter cake that has been removed from the portion of the wellbore included within the test zone.

13. The apparatus of claim 9, wherein the one or more isolation devices comprise a set of inflatable packers.

14. The apparatus of claim 9, wherein the one or more isolation devices comprise one or more hydraulic probes.

15. The apparatus of claim 9, wherein the drill stem test tool is configured to actuate one or more flow control devices located within the drill stem test tool to induce an inflow of fluid from the test zone where the drill stem test tool is deployed into the drill stem test tool and for an inflow period of time configured to remove a filter cake from an inner surface of the wellbore included within the test zone.

16. The apparatus of 15, wherein following the inflow period of time, the drill stem test tool is configured to perform a fluid injection procedure including injecting the filtered injection fluid into a portion of the wellbore isolated with the test zone.

17. A system comprising:

a drill stem test tool comprising an injection control section coupled to a test section;

a wireline coupled to the drill stem test tool, the wireline configured to position the drill stem test tool at one or more test locations within a wellbore extending into a formation; and a set of flow control devices comprising one or more pumps, the one or more pumps configured to drive a drilling fluid from a drilling fluid source into an area within the wellbore;

wherein the test section comprises one or more isolation devices configured to be deployed while the drill stem test tool is positioned at any one of the one or more test locations to create a test zone within the wellbore, wherein the injection control section is configured to withdraw a formation fluid from within the test zone and to pump the withdrawn formation fluid into a non-isolated portion of the wellbore outside of the test zone, the drilling fluid configured to pressurize the withdrawn formation fluid located within the non-isolated portion of the wellbore, wherein the pressurized flow of formation fluid is configured to be provided through the pressurization of a column of a drilling fluid located above the formation fluid located within the non-isolated portion of the test zone;

wherein the injection control section comprises a body having an input port including a filter screen, wherein the input port is configured to provide fluid communication between the non-isolated portion of the wellbore outside of the test zone and an interior fluid section of the injection control section, and wherein the filter screen is configured to filter a pressurized flow of the formation fluid provided from the non-isolated portion of the wellbore at the input port in order to provide a base fluid to the injection control section; and wherein the injection control section is configured to perform one or more fluid injection tests at the one or more test zones using the base fluid.

18. The system of claim 17, wherein the injection control section comprises a flow controller configured adjust a flow rate of fluids flowing into and from the test zone of the wellbore where the drill stem test tool has been deployed.

* * * * *